US011217139B2

(12) United States Patent
Sato et al.

(10) Patent No.: US 11,217,139 B2
(45) Date of Patent: Jan. 4, 2022

(54) DISPLAY PANEL, GATE SCANNING CIRCUIT, AND GATE SCANNING UNIT CIRCUIT

(71) Applicant: HON HAI PRECISION INDUSTRY CO., LTD., New Taipei (TW)

(72) Inventors: Hideo Sato, New Taipei (TW); Mitsuru Goto, New Taipei (TW); Wei-Cheng Chen, New Taipei (TW); Chun-Jung Shih, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/578,638

(22) Filed: Sep. 23, 2019

(65) Prior Publication Data

US 2020/0312211 A1 Oct. 1, 2020

(30) Foreign Application Priority Data

Mar. 29, 2019 (CN) ..... 201910251555.6

(51) Int. Cl.
*G09G 3/20* (2006.01)
*G09G 3/3266* (2016.01)

(52) U.S. Cl.
CPC ..... *G09G 3/20* (2013.01); *G09G 2300/0426* (2013.01); *G09G 2300/0809* (2013.01); *G09G 2310/0267* (2013.01); *G09G 2310/08* (2013.01)

(58) Field of Classification Search
CPC ..... G09G 3/20; G09G 3/36; G09G 3/3266; H03K 19/096; G11C 19/28
See application file for complete search history.

(56) References Cited

U.S. PATENT DOCUMENTS

2005/0285840 A1* 12/2005 Jang ..... G11C 19/184 345/100
2008/0079685 A1* 4/2008 Umezaki ..... G11C 19/28 345/100
2008/0219401 A1* 9/2008 Tobita ..... G11C 19/28 377/79
2010/0134396 A1* 6/2010 Umezaki ..... G02F 1/13624 345/92
2011/0057190 A1* 3/2011 Kimura ..... G11C 19/28 257/59
2015/0076576 A1 3/2015 Umezaki
(Continued)

FOREIGN PATENT DOCUMENTS

CN 104103242 A 10/2014
CN 105448267 A 3/2016

*Primary Examiner* — Ke Xiao
*Assistant Examiner* — James S Nokham
(74) *Attorney, Agent, or Firm* — ScienBiziP, P.C.

(57) ABSTRACT

A gate scanning unit circuit is applied in a display panel including a number of gate lines and a driver configured to output clock signals. The gate scanning unit circuit is configured to scan the number of gate lines. The gate scanning unit circuit includes a flip-flop and at least two output units. The flip-flop is configured to output a trigger signal. Each output unit is connected to the flip-flop and the driver. Each of the at least two output units is connected to the number of gate lines one-to-one. The output unit is configured to output a gate scan signal to the corresponding connected gate line according to the trigger signal and the clock signals.

16 Claims, 21 Drawing Sheets

(56) References Cited

U.S. PATENT DOCUMENTS

| | | | | |
|---|---|---|---|---|
| 2015/0269896 | A1* | 9/2015 | Umezaki | G09G 3/20 345/100 |
| 2017/0031477 | A1* | 2/2017 | Jamshidi Roudbari | G09G 3/3266 |
| 2018/0061346 | A1* | 3/2018 | Zhao | G09G 3/3677 |
| 2019/0066620 | A1* | 2/2019 | Park | G09G 3/3266 |

* cited by examiner

DISPLAY PANEL, GATE SCANNING CIRCUIT, AND GATE SCANNING UNIT CIRCUIT

FIELD

The subject matter herein generally relates to display panels, and more particularly to a display panel including a gate scanning circuit including a plurality of gate scanning unit circuits.

BACKGROUND

Generally, a display device includes a plurality of gate lines, a plurality of signal lines disposed perpendicularly to the plurality of gate lines, and a gate line scanning circuit disposed on opposite sides of a display area for scanning the plurality of gate lines. A scanning method is that the gate line scanning circuit on one side scans the odd-numbered gate lines, and the gate line scanning circuit on the other side scans the even-numbered gate lines.

In shaped display panels in which a portion of the display panel is cut out, due to the above-described gate line scanning method, the gate lines corresponding to the cut out portion are separated into two sections, and the two sections are connected to establish an electrical connection. However, this may limit reduction of a frame width of the display panel.

BRIEF DESCRIPTION OF THE DRAWINGS

Implementations of the present disclosure will now be described, by way of embodiments, with reference to the attached figures.

DETAILED DESCRIPTION

Figure 1:
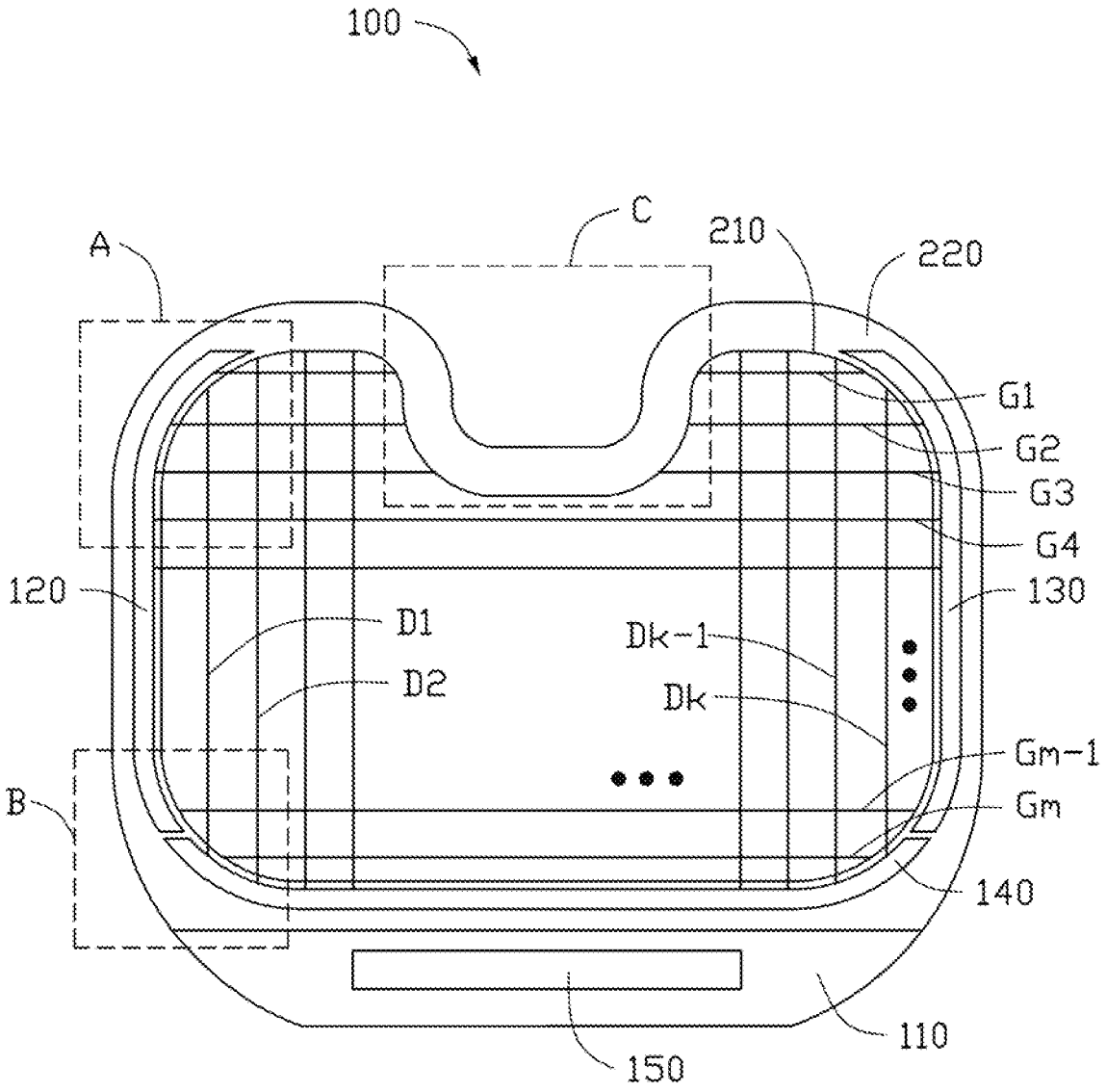
FIG. 1 is a schematic structural view of an embodiment of a first embodiment of a display panel.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows a first embodiment of a display panel 100. The display panel 100 includes a thin film transistor substrate (hereinafter "the TFT substrate 110"), a plurality of gate lines G1-Gm arranged in parallel on the TFT substrate 110, a plurality of signal lines D1-Dk arranged in parallel on the TFT substrate 110 and perpendicular to the plurality of gate lines G1-Gm, a first gate scanning circuit 120 and a second gate scanning circuit 130 arranged on the TFT substrate 110, a signal line scanning circuit 140 arranged on the TFT substrate 110, and a driver 150. The TFT substrate 110 defines a display area 210 and a non-display area 220. The display area 210 is a substantially central portion of the display panel 100, and the non-display area 220 surrounds the display area 210. The plurality of gate lines G1-Gm and the plurality of signal lines D1-Dk are all located in the display area 210. The first gate scanning circuit 120, the second gate scanning circuit 130, the signal line scanning circuit 140, and the driver 150 are located in the non-display area 220. The display area 210 is used for display, and the non-display area 220 corresponds to a border of the display panel 100.

Referring to FIG. 1, the display panel 100 defines an area C located at an upper central edge of the display panel 100. The area C includes straight edges and rounded corners. A remaining part of the display area 210 further includes straight edges and rounded corners corresponding to straight edges and rounded edges of the display panel 100. The first gate scanning circuit 120, the second gate scanning circuit 130, and the signal line scanning circuit 140 are located around the display area 210. The first gate scanning circuit 120 and the second gate scanning circuit 130 are respectively located at opposite sides of the display area 210. The signal line scanning circuit 140 is located between the first gate scanning circuit 120 and the second gate scanning circuit 130 at a lower portion of the display area 210.

Figure 2:
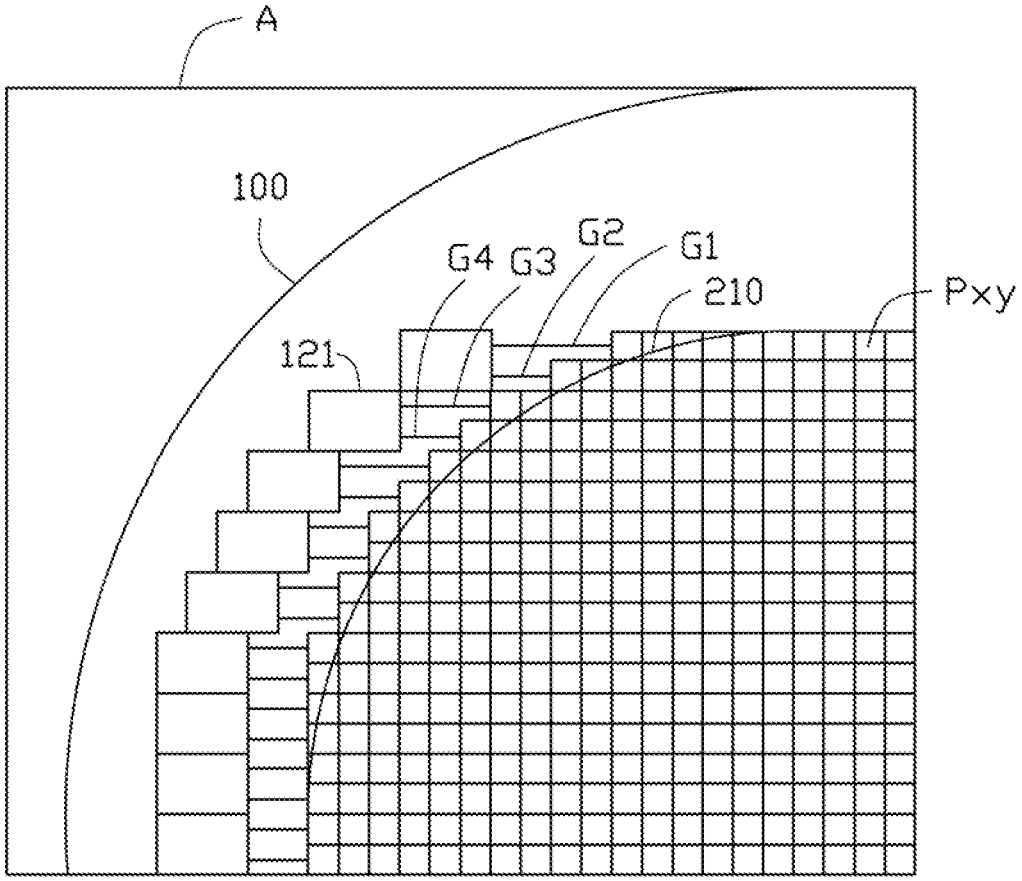
FIG. 2 is a schematic enlarged view of region A of FIG. 1.

Referring to FIG. 1 and FIG. 2, the plurality of gate lines G1-Gm and the plurality of signal lines D1-Dk are insulated from each other and perpendicularly cross each other in the display area 210 to form a plurality of array-type pixel regions Pxy. The pixel regions Pxy are a minimum display unit of the display panel 100. Each pixel region Pxy displays according to a signal loaded on one gate line and one signal line. Each pixel region Pxy in a same row is connected to a same gate line, and each pixel region Pxy in a same column is connected to a same signal line. The gate lines G1-Gm are connected to the first gate scanning circuit 120 and the second gate scanning circuit 130 and are scanned from opposite sides by the first gate scanning circuit 120 and the second gate scanning circuit 130, respectively. The signal lines D1-Dk are connected to the signal line scanning circuit 140 and are scanned by the signal line scanning circuit 140.

The first gate scanning circuit 120 and the second gate scanning circuit 130 have substantially a same structure. For convenience of description, only the first gate scanning circuit 120 is described. FIG. 2 shows an enlarged view of area A in FIG. 1. The first gate scanning circuit 120 includes a plurality of gate scanning unit circuits 121, and each of the gate scanning unit circuits 121 connects two adjacent gate lines. In other embodiments, the two gate lines connected by the gate scanning unit circuit 121 may not be adjacent. A connection manner as described in this embodiment can minimize a required amount of traces, which is advantageous for reducing a required area of the non-display area 220, thereby reducing a frame width of the display panel 100.

Figure 3:
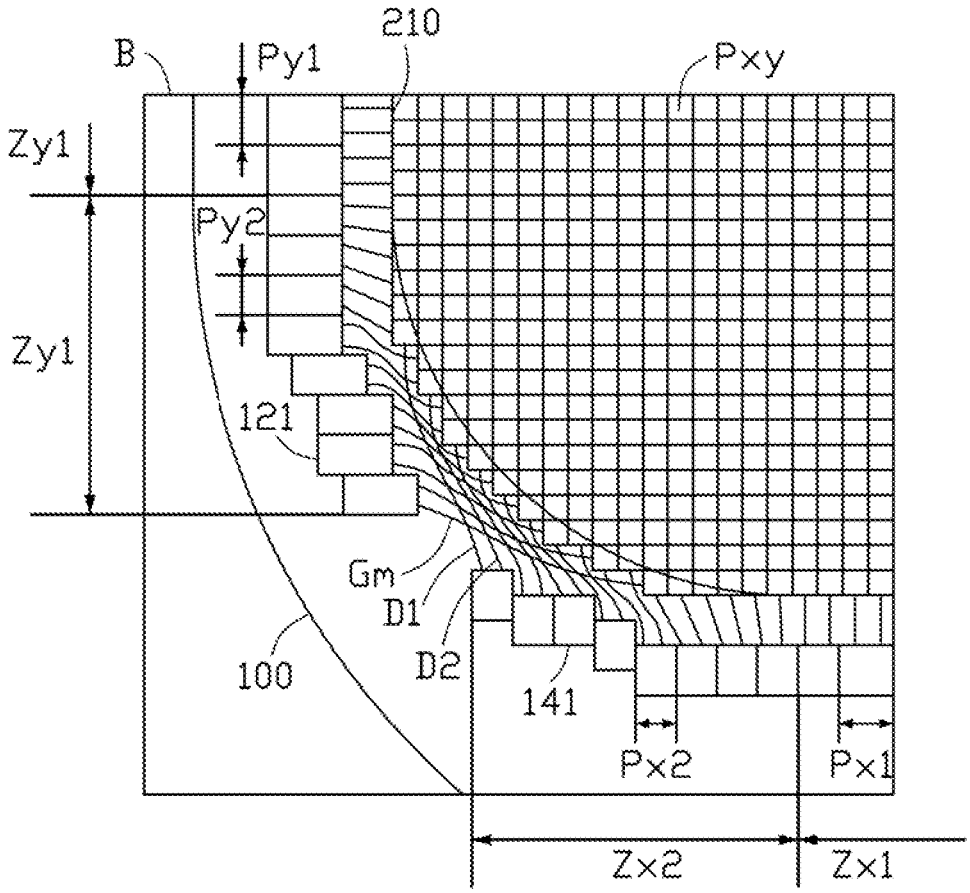
FIG. 3 is a schematic enlarged view of region B of FIG. 1.

Referring to FIG. 1 and FIG. 3, the signal line scanning circuit 140 includes a plurality of signal line scanning unit circuits 141 connected to the signal lines D1-Dk.

FIG. 3 shows an enlarged view of area B in FIG. 1. Area B includes a straight edge area Zy1, a straight edge area Zx1, a rounded area Zy2, and a rounded area Zx2. A spacing between the gate scanning unit circuits 121 of the straight edge area Zy1 is represented as Py1. A spacing between the signal line scanning unit circuits 141 of the straight edge area Zx1 is represented as Px1. A spacing between the gate scanning unit circuits 121 of the rounded area Zy2 is represented as Py2. A spacing between the signal line scanning unit circuits 141 of the rounded area Zx2 is represented as Px2.

The area B is a boundary area between the gate scanning unit circuits 121 and the signal line scanning unit circuits 141. In order to conform to an edge contour of the display area 210 without increasing a width of the non-display area 220, the spacing Py2 between the gate scanning unit circuits 121 of the rounded area Zy2 is less than the spacing Py1 between the gate scanning unit circuits 121 of the straight edge area Zy1, and the spacing Px2 between the signal line scanning unit circuits 141 of the rounded area Zx2 is less than the spacing Px1 of the signal line scanning unit circuits 141 of the straight edge area Zx1. Thus, the spacing Py2 and the spacing Py1 have a relationship Py2<Py1, and the spacing Px2 and the spacing Px1 have a relationship Px2<Px1.

The gate scanning unit circuit 121 includes a flip-flop and at least two output units. Each of the output units is connected to the flip-flop and the driver 150. The output units are connected to the gate lines in one-to-one correspondence. The output units are configured to output a gate scanning signal to the corresponding gate lines according to a trigger signal output by the flip-flop and a clock signal output by the driver 150.

Figure 4:
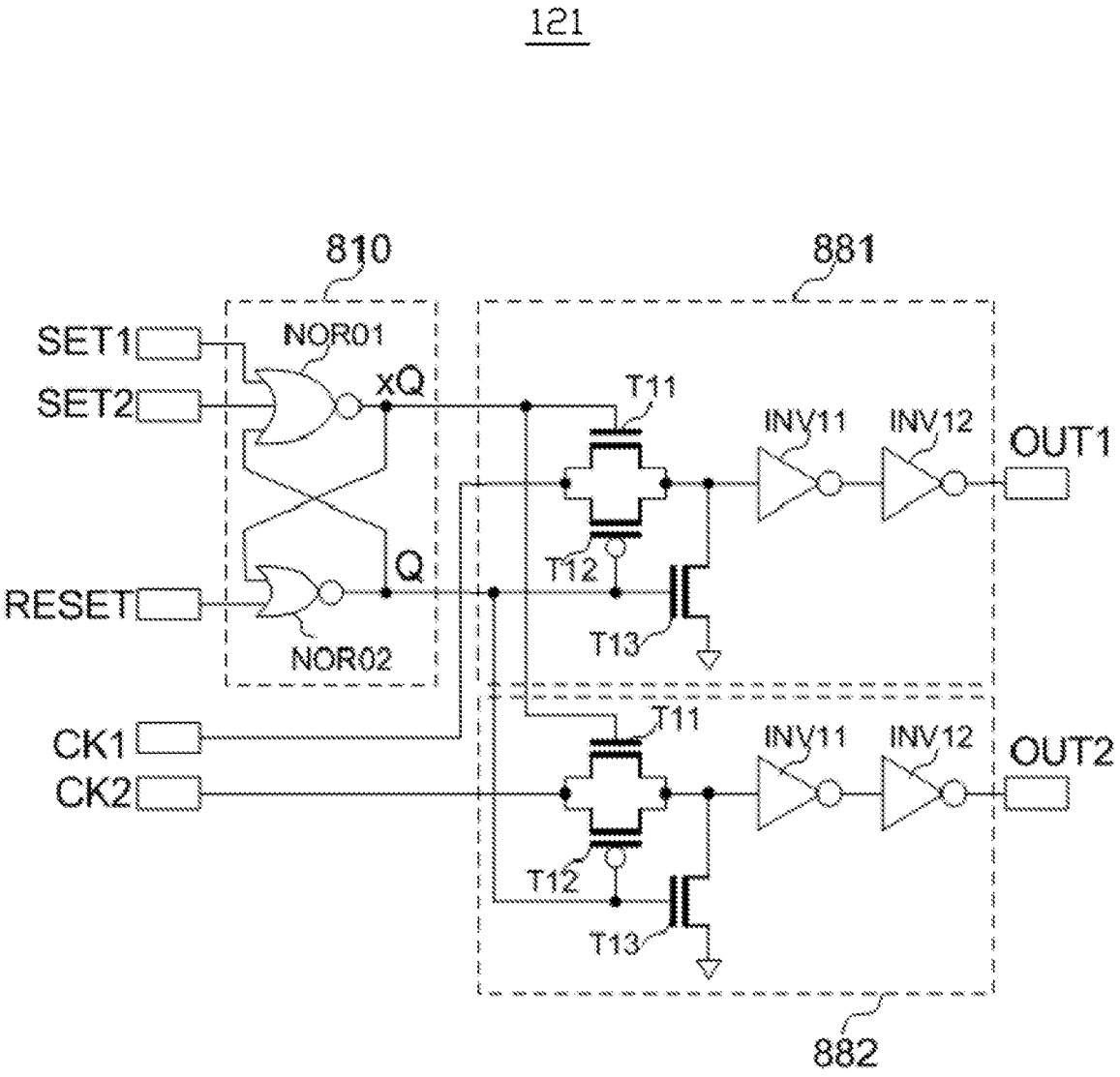
FIG. 4 is a schematic diagram showing a circuit structure of a gate scanning unit circuit.

Referring to FIG. 1 and FIG. 4, the gate scanning unit circuit 121 includes a flip-flop 810, a first output unit 881, and a second output unit 882. The first output unit 881 and the second output unit 882 are connected to the flip-flop 810. In one embodiment, the first output unit 881 and the second output unit 882 have a same circuit structure.

The first output unit 881 is connected to a first gate line and the driver 150, and the second output unit 882 is connected to a second gate line and the driver 150. The first gate line and the second gate line are arranged adjacent to each other, thereby facilitating reduction of the traces and a required width of the bezel. In other embodiments, one gate scanning unit circuit 121 includes a plurality of output units, each of which is connected to one gate line, so that each gate scanning unit circuit 121 is connected to a plurality of gate lines, which is advantageous for reducing traces.

The flip-flop 810 is a set/reset flip-flop composed of two NOR gates NOR01 and NOR02. The flip-flop 810 receives two set signals SET1 and SET2 and a reset signal RESET for outputting a first trigger signal QB and a second trigger signal Q. A truth table of the trigger 810 is as follows:

| SET1 | SET2 | RESET | Q | $Q_B$ |
|---|---|---|---|---|
| L | L | L | Qn-1 | $Q_B$ (n-1) |
| H | — | L | H | L |
| — | H | L | H | L |
| L | L | H | L | H |
| H | — | H | Undefined | Undefined |
| — | H | H | Undefined | Undefined |

The first output unit 881 and the second output unit 882 have substantially a same circuit structure and include a first transistor T11, a second transistor T12, a third transistor T13, an inverter INV11, and an inverter INV12. The first transistor T11 and the third transistor T13 are N-type field-effect transistors, and the second transistor T12 is a P-type field-effect transistor.

In the first output unit 881, a gate of the first transistor T11 is connected to an output end of the first trigger signal QB of the flip-flop 810, and a gate of the second transistor T12 is connected to an output end of the second trigger signal Q of the flip-flop 810. A source of the first transistor T11 and a source of the second transistor T12 are connected to each other and connected to the driver 150 and receive a first clock signal CK1 output by the driver 150. A drain of the first transistor T11 and a drain of the second transistor T12 are sequentially connected to the inverter INV11 and the inverter INV12. The first output unit 881 has a first output terminal OUT1, and the first output terminal OUT1 is connected to the inverter INV12 and a first gate line G1. The first output terminal OUT1 of the first output unit 881 outputs a first gate scan signal according to the second trigger signal Q and the first clock signal CK1, and the first gate scan signal is a logic AND of the second trigger signal Q and the first clock signal CK1.

The second output unit 882 is substantially similar to the first output unit 881. In the second output unit 882, the source of the first transistor T11 and the source of the second transistor T12 are connected to each other and connected to the driver 150 and receive a second clock signal CK2 output by the driver 150. A drain of the first transistor T11 and a drain of the second transistor T12 are sequentially connected to the inverter INV11 and the inverter INV12, the second output unit 882 has a second output terminal OUT2. The second output terminal OUT2 is connected to the inverter INV12 and a second gate line G2. The second output terminal OUT 2 of the second output unit 882 outputs a second gate scan signal according to the second trigger signal Q and the second clock signal CK2, and the second gate scan signal is a logic AND of the second trigger signal Q and the second clock signal CK2.

Operation timing of the gate scanning unit circuit will be described below. A scanning mode of the gate lines may be forward scanning, such as scanning from top to bottom in the order of G1 to Gm, or may be reverse scanning, such as scanning from bottom to top in the order of Gm to G1.

Figure 5:
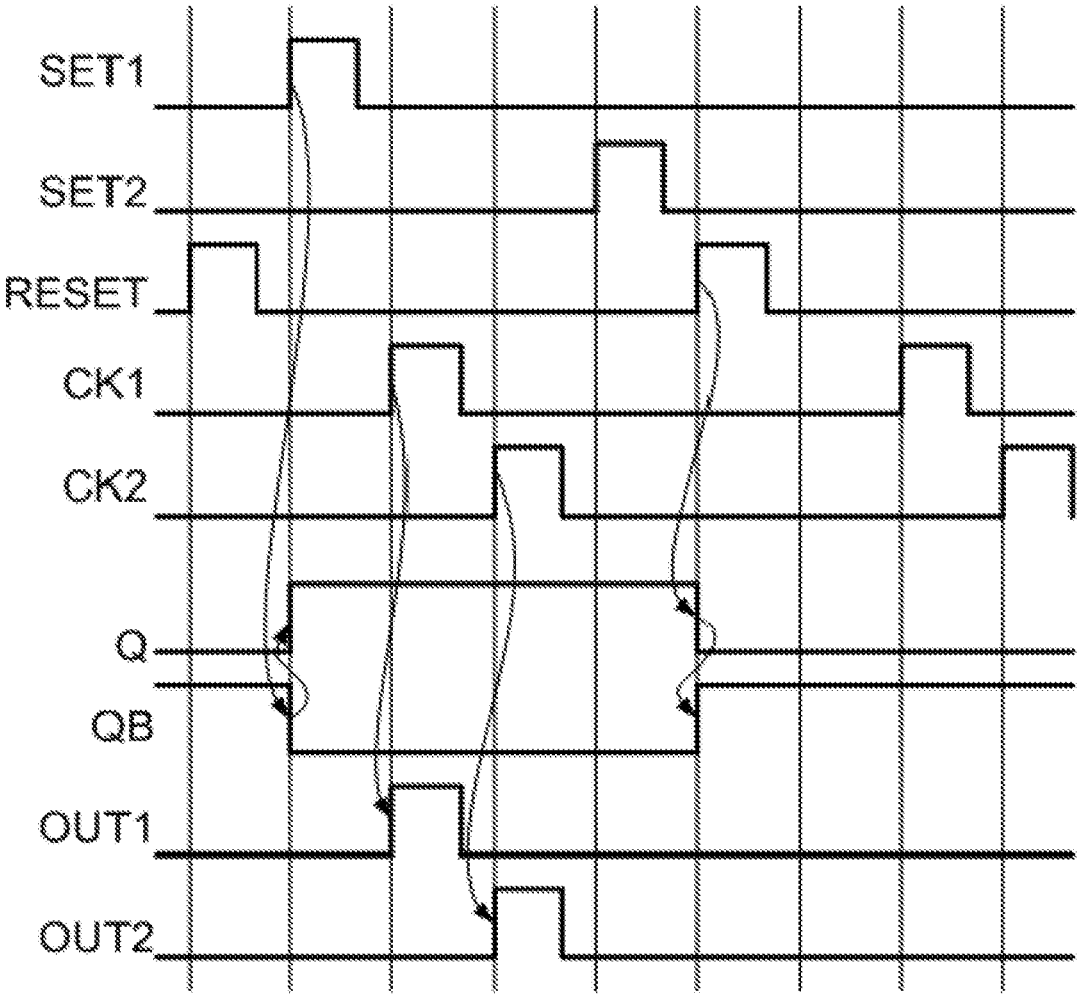
FIG. 5 is a timing diagram showing a forward scanning mode of the gate scanning unit circuit of FIG. 4.

FIG. 5 shows a diagram of the forward scanning mode. The first set signal SET1, the first clock signal CK1, the second clock signal CK2, and the reset signal RESET are sequentially changed to a high level. When the first set signal SET1 is changed to the high level, the first trigger signal QB of the flip-flop 810 outputs a low level, and the second trigger signal Q outputs a high level. In the above-described scenario, when the first clock signal CK1 and the second clock signal CK2 are changed to the high level, the first gate scan signal (the signal output from the first output terminal OUT1) and the second gate scan signal (the signal output from the second output terminal OUT2) are output at the high level.

Further, the second set signal SET2 changing to the high level does not change a level of the first trigger signal QB and the second trigger signal Q output by the flip-flop 810. Next, when the reset signal RESET changes to the high level, the second trigger signal Q changes to the low level, and the first trigger signal QB changes to the high level.

As described above, in the forward scanning mode from the first gate scan signal to the second gate scan signal, a clock of 5 or more phases is required from the first set signal SET1 to the reset signal RESET.

An overall structure and operation timing of the first gate scanning circuit 120 including the gate scanning unit circuit 121 of FIG. 4 will be described below. The second gate scanning circuit 130 has a similar structure and operation timing as the first gate scanning circuit 120.

Figure 6:
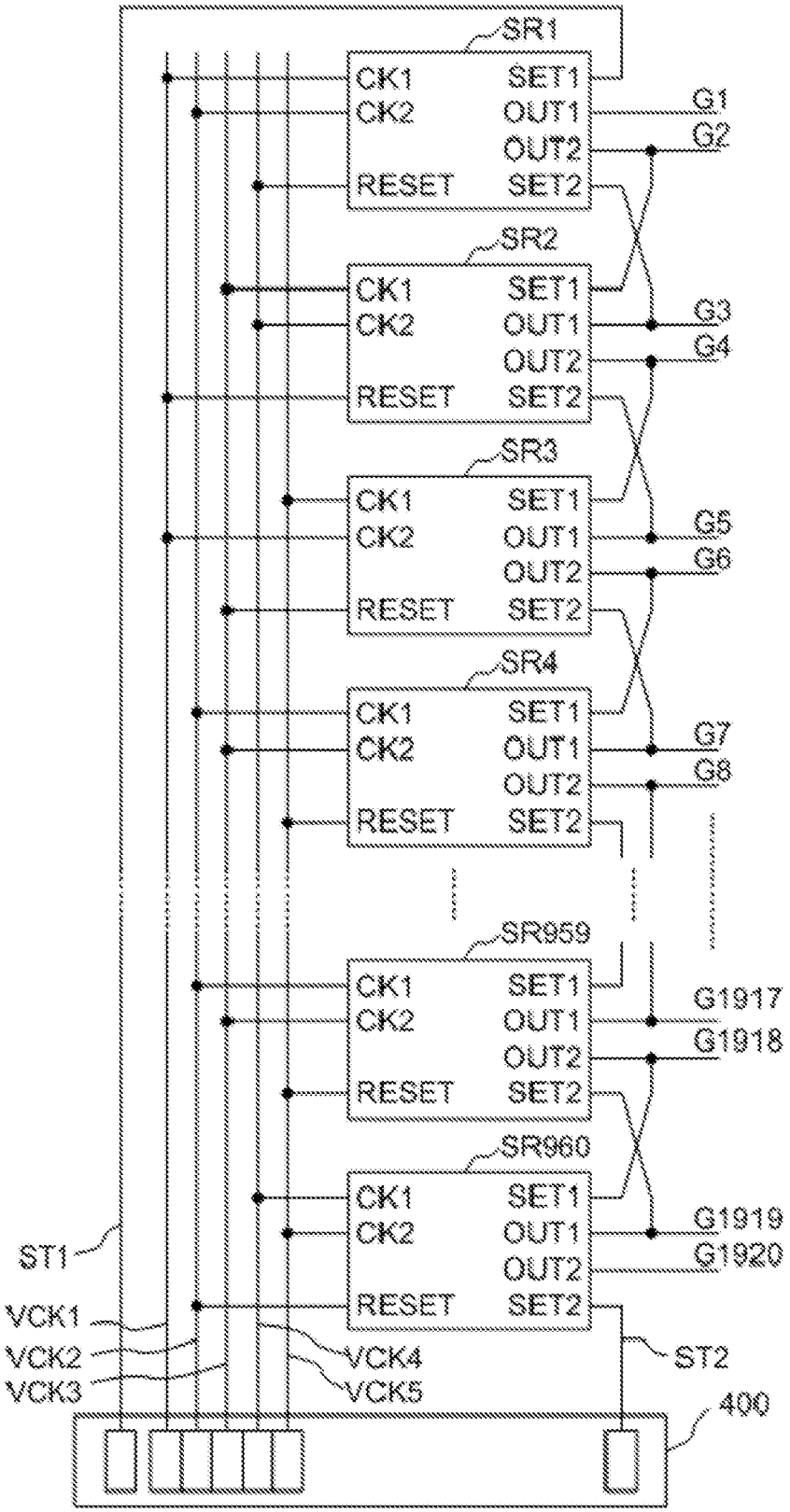
FIG. 6 is a schematic diagram showing a circuit structure of a first gate scanning circuit in the first embodiment.

Referring to FIG. 6, in one embodiment, there are 1920 scan lines, which are respectively denoted as G1-G1920, and the first gate scanning circuit 120 includes 960 gate scanning unit circuits 121, which are respectively denoted as SR1-SR960. Each of the gate scanning unit circuits SR1-SR960 is connected to two adjacent gate lines. For example, the gate scanning unit circuit SR1 is connected to the gate lines G1 and G2, and the gate scanning unit circuit SR2 is connected to the gate lines G3 and G4. The first gate scanning circuit 120 operates in accordance with 5-phase clock signals VCK1-VCK5 output from the driver 150 and start signals ST1 and ST2, and outputs gate scan signals to the respective gate lines G1-G1920.

Each of the gate scanning unit circuits 121 is connected step-by-step. Using the gate scanning unit circuit SR3 as an example, the gate scanning unit circuit SR3 is connected to the driver 150, an adjacent upper-stage gate scanning unit circuit SR2, and an adjacent lower-stage gate scanning unit circuit SR4. An input terminal of the set signal SET1 of the gate scanning unit circuit SR3 is connected to the second output terminal OUT2 of the upper-stage gate scanning unit circuit SR2, and an input terminal of the set signal SET2 of the gate scanning unit SR3 is connected to the first output terminal OUT1 of the lower-stage gate scanning unit circuit SR4. The driver 150 outputs five clock signals VCK1-VCK5. The first clock signal CK1 input to the gate scanning unit circuit SR3 is the clock signal VCK5, and the second clock signal CK2 is the clock signal VCK1.

Figure 7:
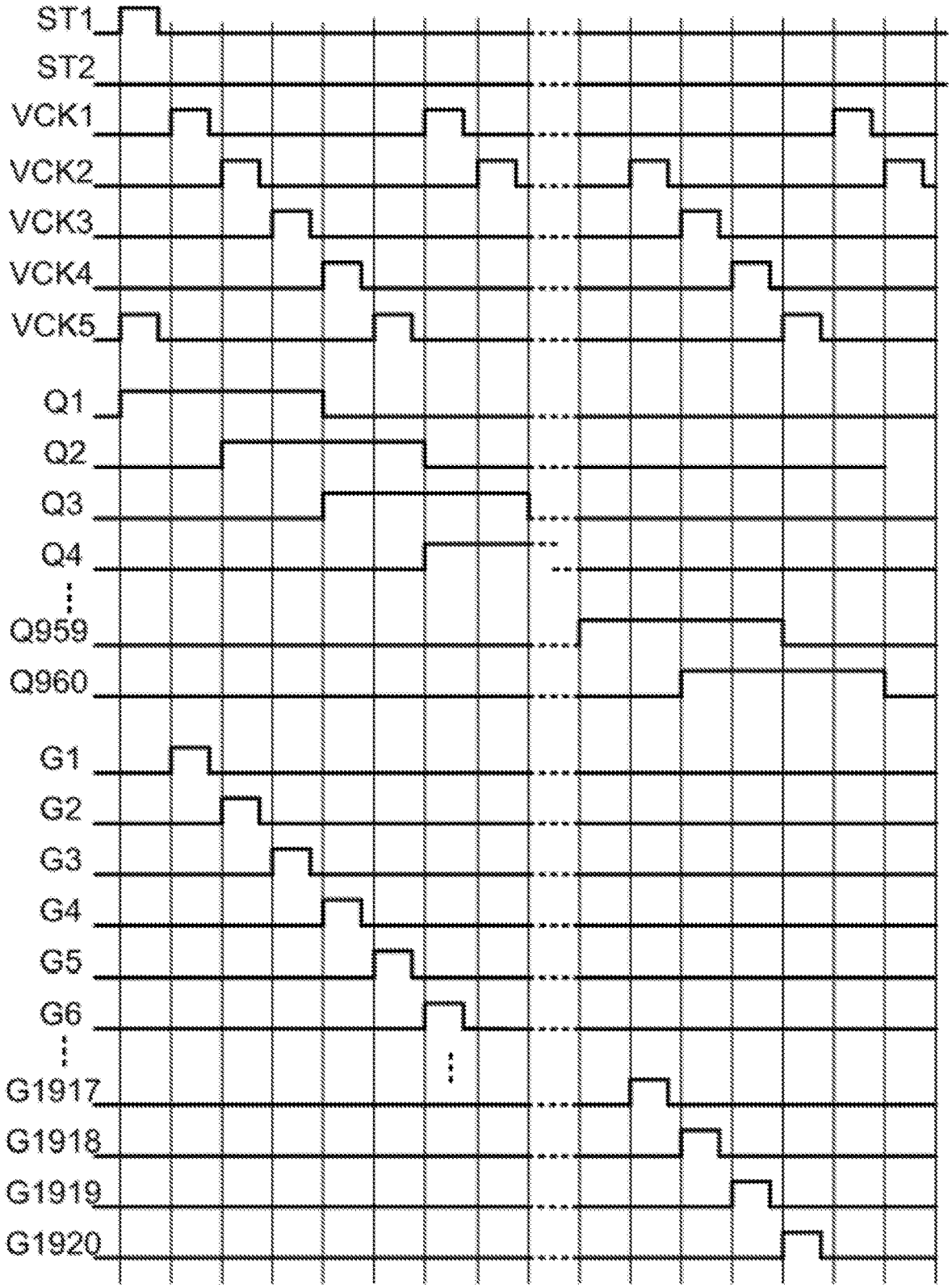
FIG. 7 is a timing diagram showing the forward scanning mode of the gate scanning circuit in FIG. 6.

Referring to FIG. 4, FIG. 6, and FIG. 7, the gate scanning unit circuits SR1-SR960 adopt the forward scanning mode, and the gate scanning circuit as shown in FIG. 6 adopts the forward scanning mode. The clock signals VCK1, VCK2, VCK3, VCK4, and VCK5 are sequentially changed to a high level. The start signal ST1 changes to a high level in the timing of the clock signal VCK5, and the start signal ST2 changes to a low level in the timing of the clock signal VCK5. The second trigger signal Q1 output from the flip-flop 810 of the gate scanning unit circuit becomes a high level in the timing of the start signal ST1, and becomes a low level in the timing of the clock signal VCK4. By outputting the second trigger signal Q1 here, the scan signals on the gate lines G1 and G2 become a high level in the timing of the clock signals VCK1 and VCK2. Further, the second trigger signal Q2 output from the flip-flop 810 of the gate scanning unit circuit SR2 becomes a high level in the timing of the scan signal on the gate line G2, and becomes a low level in the timing of the clock signal VCK1. By outputting the second trigger signal Q2 here, the scan signals on the gate lines G3 and G4 become a high level in the timing of the clock signals VCK3 and VCK4. Similarly, the timing of the second trigger signal Q3 output from the flip-flop 810 of the gate scanning unit circuit SR2 becomes a high level in the timing of the scan signal on the gate line G4, and becomes a low level in the timing of the clock signal VCK3. By outputting the second trigger signal Q3 here, the scan signals on the gate lines G5 and G6 become a high level in the timings of the clock signals VCK5 and VCK1, respectively, and the output timings of the subsequent respective signals are similar as described above, and will not be further described herein.

Figure 8:
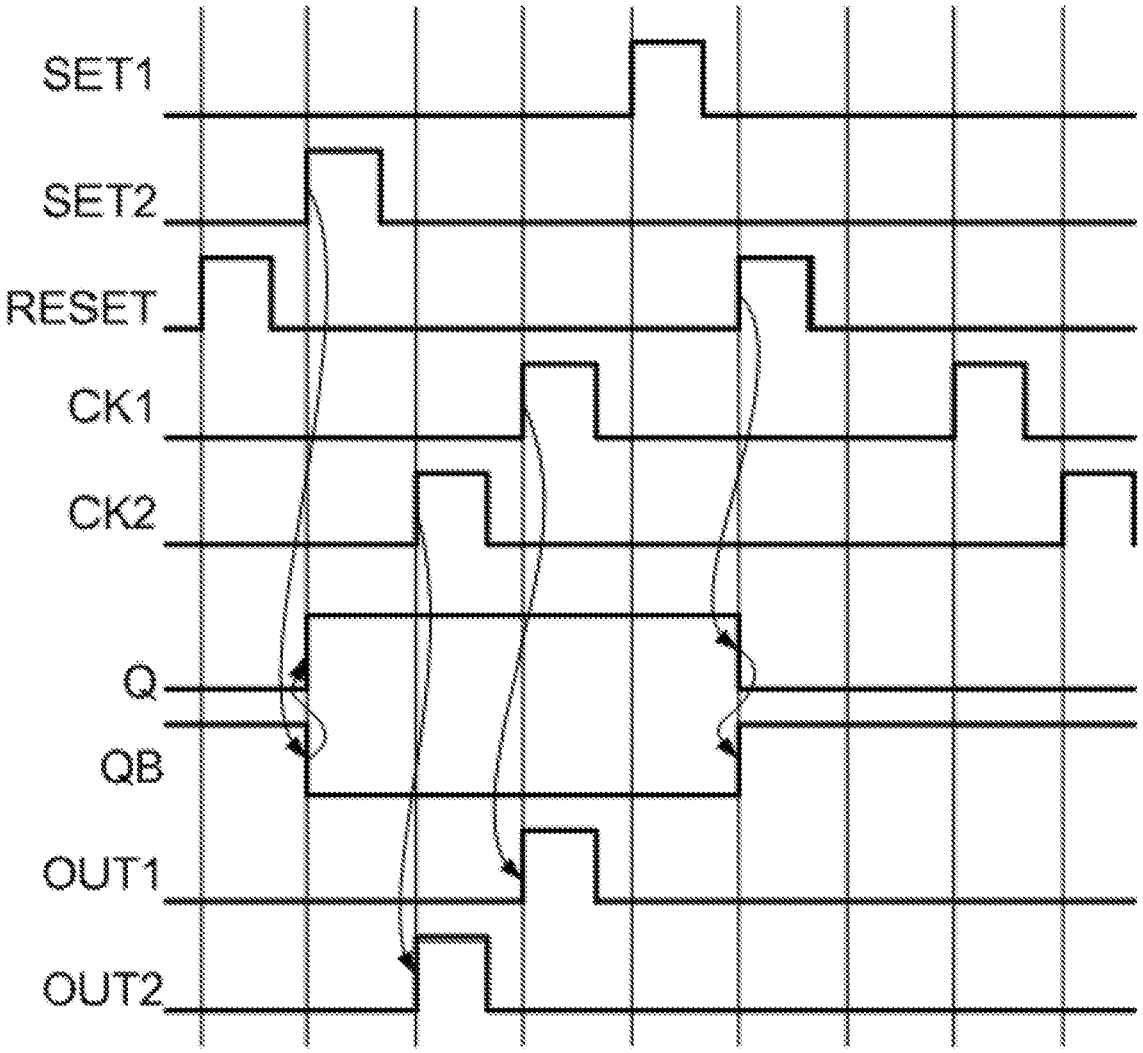
FIG. 8 is a timing diagram showing a reverse scanning mode of the gate scanning unit circuit in FIG. 4.

Referring to FIG. 4, FIG. 5, and FIG. 8, in a reverse scanning mode, a level of the input signals of the gate scanning unit circuits 121 are opposite as shown in FIG. 5. The set signal SET2, the second clock signal CK2, the first clock signal CK1, the set signal SET1, and the reset signal RESET sequentially change to the high level. When the set signal SET2 becomes a high level, the first trigger signal QB output from the flip-flop 810 becomes a low level, and the second trigger signal Q becomes a high level. When the second clock signal CK2 and the first clock signal CK1 become a high level, the second gate scan signal and the first gate scan respectively become the high level in sequence in the timing of the second clock signal CK2 and the first clock signal CK1. Further, when the set signal SET1 becomes a high level, the second trigger signal Q and the first trigger signal QB of the flip-flop 810 do not change. Next, when the reset signal RESET becomes a high level, the second trigger signal Q of the flip-flop 810 becomes a low level, and the first trigger signal QB becomes a high level.

As described above, in the reverse scanning mode, the timing is reversed from the second gate scan signal to the first gate scan signal. Moreover, the timing from the set signal to the reset signal is the same as that shown in FIG. 5, that is, a clock of five or more phases is required.

Figure 9:
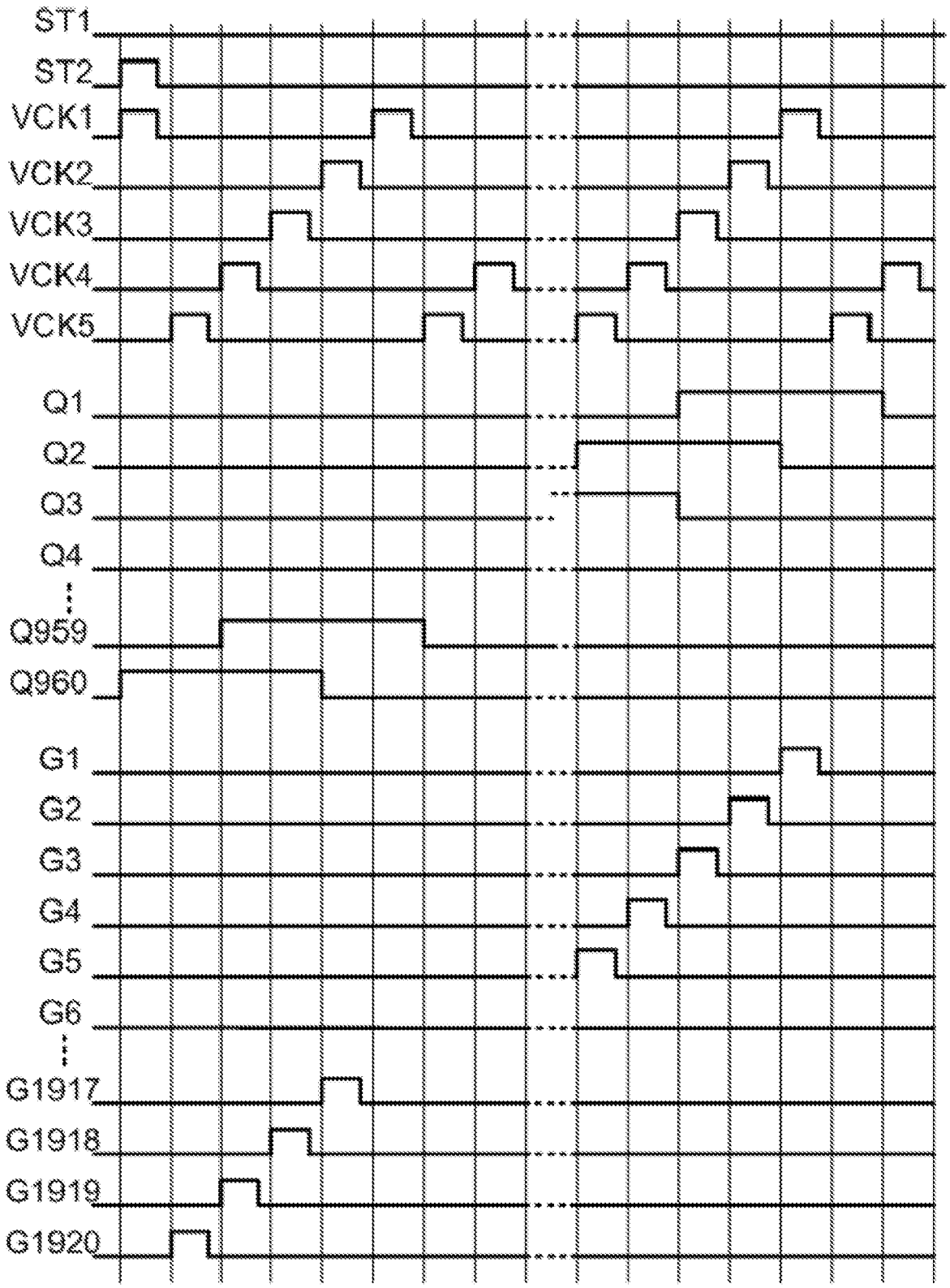
FIG. 9 is a timing diagram showing the reverse scanning mode of the gate scanning circuit in FIG. 6.

Referring to FIG. 6 and FIG. 9, when the gate scanning unit circuits SR1-SR960 scan in the reverse scanning mode, the first gate scanning circuit 120 also scans in the reverse scanning mode. The clock signals VCK5, VCK4, VCK3, VCK2, and VCK1 sequentially change to the high level. The start signal ST1 becomes a low level, and the start signal ST2 becomes a high level at the timing of the clock signal VCK1. The second trigger signal Q960 output from the gate scanning unit circuit SR960 becomes a high level at the timing of the start signal ST2, and becomes a low level at the timing of the clock signal VCK2. By outputting the second trigger signal Q960, the scanning signals on the gate lines G1920, G1919 sequentially become high levels at the timings of the clock signals VCK5 and VCK4, respectively. Further, the second trigger signal Q959 of the above-described gate scanning unit circuit SR959 becomes a high level at the timing of the gate line scanning signal G1919, and becomes a low level at the timing of the clock signal VCK5. By outputting the second trigger signal Q959, the scanning signals on the gate lines G1918 and G1917 sequentially become the high level at the timings of the clock signals VCK3 and VCK2, respectively.

As described above, the scanning signals on the gate lines G1-G1920 are signals whose phases are changed in the reverse direction, that is, the reverse scanning mode is realized.

The circuit structure and the operation timing of the first gate scanning circuit 120 are the same as the circuit structure and the operation timing of the second gate scanning circuit 130. The first gate scanning circuit 120 and the second gate scanning circuit 130 include the same number of gate scanning unit circuits 121, and the gate scanning unit circuits 121 in the first gate scanning circuit 120 are in one-to-one correspondence with the gate scanning unit circuits 121 in the second gate scanning circuit 130. Each gate scanning unit circuit 121 in the first gate scanning circuit 120 and the corresponding gate scanning unit circuit 121 in the second gate scanning circuit 130 are connected to the same two gate lines, that is, each gate line is scanned simultaneously by the corresponding two gate scanning unit circuits 121. Thus, even though the display panel 100 defines the area C where corresponding gate lines are cut into separate segments, each segment is connected to a corresponding gate scanning unit circuit to perform scanning. Thus, it is not necessary to set a trace connection between the two segments, which is advantageous for reducing a frame width of the display panel 100.

Moreover, in the gate scanning unit circuit, one flip-flop is connected to two output units, each output unit is connected to one gate line, and one gate scanning unit circuit is connected to two gate lines, thereby reducing the required number of flip-flops. Thus, a manufacturing cost and a frame width of the display panel are reduced.

Figure 10:
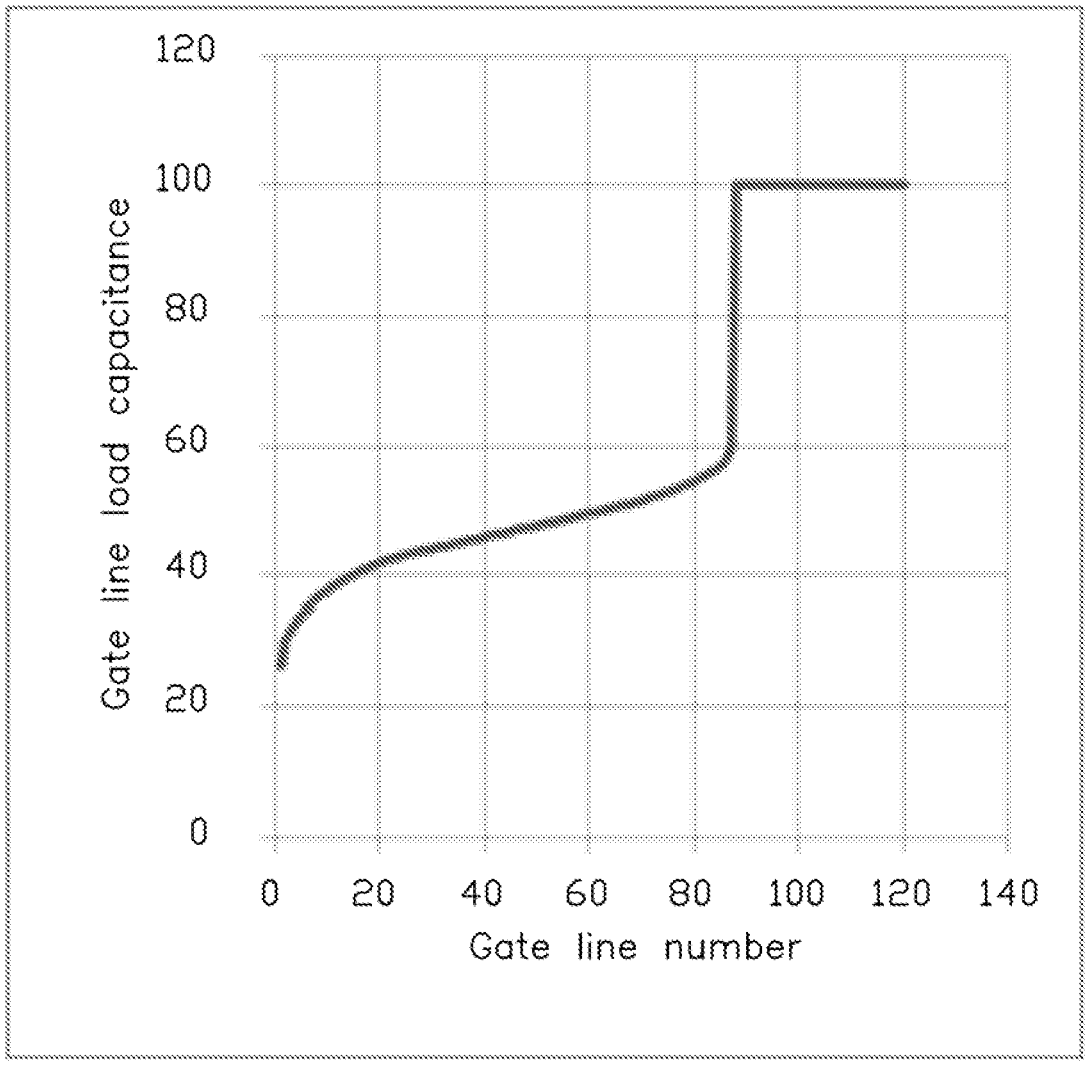
FIG. 10 is a schematic diagram showing a load capacitance of a portion of gate lines in the display panel.
Figure 11:
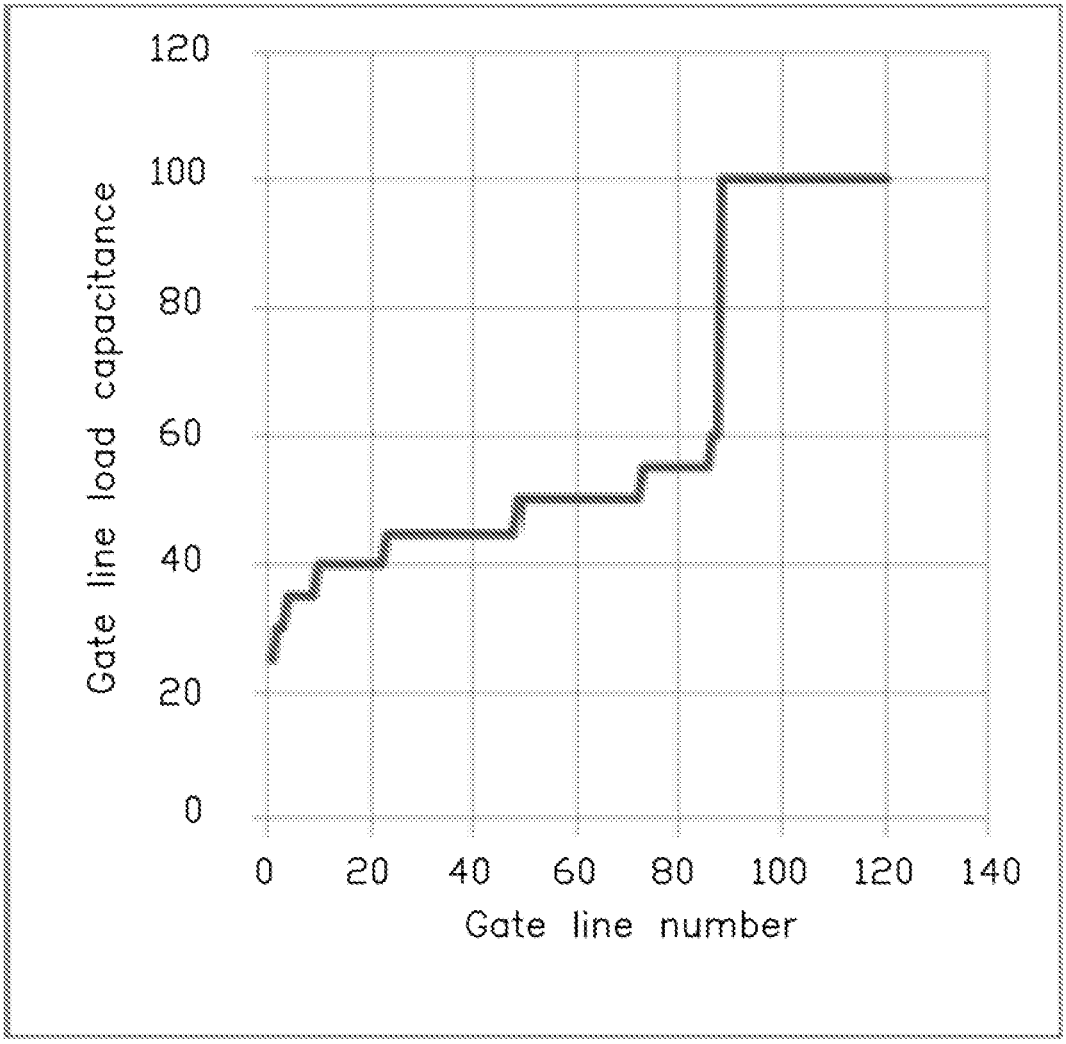
FIG. 11 is a schematic view showing a gate width of a transistor constituting an inverter in a gate scanning unit circuit to which a portion of gate lines are connected in the display panel.

Referring to FIG. 10 and FIG. 11, a gate line load capacitance is proportional to a number of pixel regions connected to the gate line. The number of pixel regions connected to the gate line separated by the area C is less due to the reduced length of the gate line. If there are less pixel regions connected to the gate line, the load capacitance of the gate line is less. A waveform of a scan signal voltage on the gate line depends on the load capacitance of the gate line. In particular, a fall time of a drive voltage waveform affects a feedthrough voltage of a pixel voltage. When the feedthrough voltage is changed, the pixel voltage also changes, which causes a problem of flicker and display unevenness.

Figure 12:
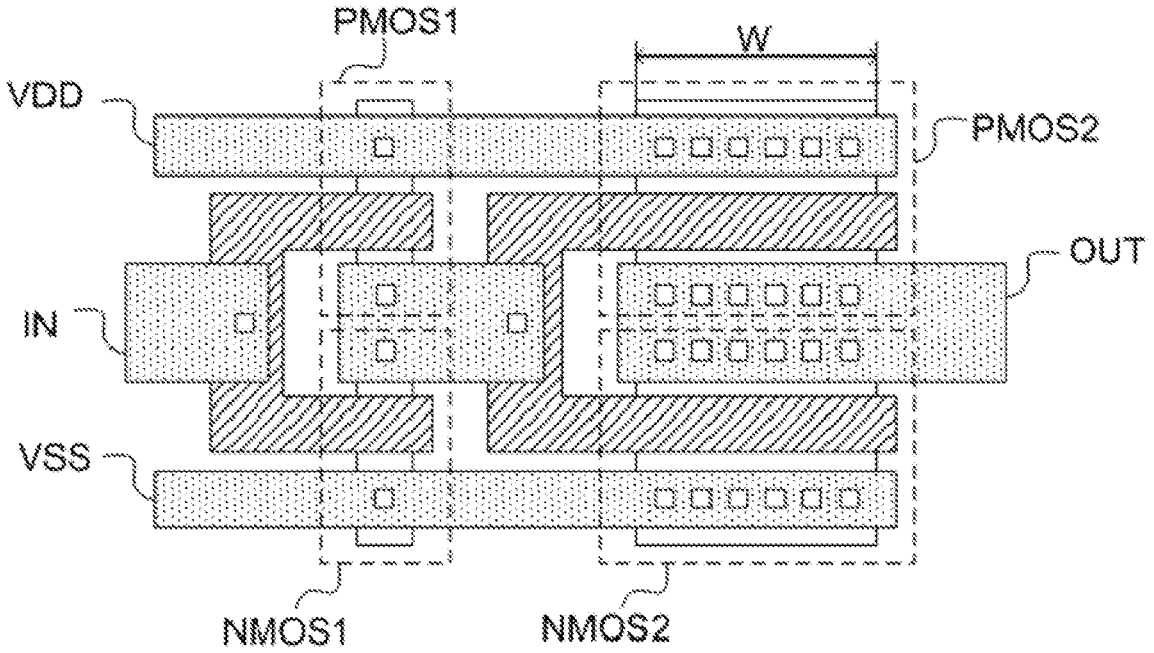
FIG. 12 is a schematic structural view of an inverter in a gate scanning unit circuit.

FIG. 12 shows a schematic diagram of a layout of the inverter INV11 and the inverter INV12 of the first output unit 881 and the second output unit 882. The inverter INV11 includes a P-type field-effect transistor PMOS1 and a N-type field-effect transistor NMOS1. The inverter INV12 includes a P-type field-effect transistor PMOS2 and a N-type field-effect transistor NMOS2. PMOS 2 and NMOS 2 have a gate width W. In one embodiment, the gate width W of the transistors PMOS1, NMOS1, PMOS2, and NMOS2 of the inverter INV11 and of the inverter INV12 in the first output unit 881 and the second output unit 882 of the gate scanning unit circuit is proportional to the load capacitance of the corresponding gate line connected to the gate scanning unit circuit.

As described above, even if the load capacitance of different gate lines is different due to the existence of the area C, the gate width W of the transistors in the inverter INV11 and in the inverter INV12 are set so that a scanning signal waveform of each gate line can be controlled, which is advantageous in preventing flicker and display unevenness.

In another embodiment, all of the gate lines may be divided into multiple groups according to the load capacitance of each gate line, such that the gate lines in each group have a similar load capacitance, and the width W of the transistors (including PMOS1, NMOS1, PMOS2, and NMOS2) in the inverter INV11 and the inverter INV12 in the gate scanning unit circuits 121 in the same group are set to be the same. In this way, production costs can be reduced.

Embodiment 2

Figure 13:
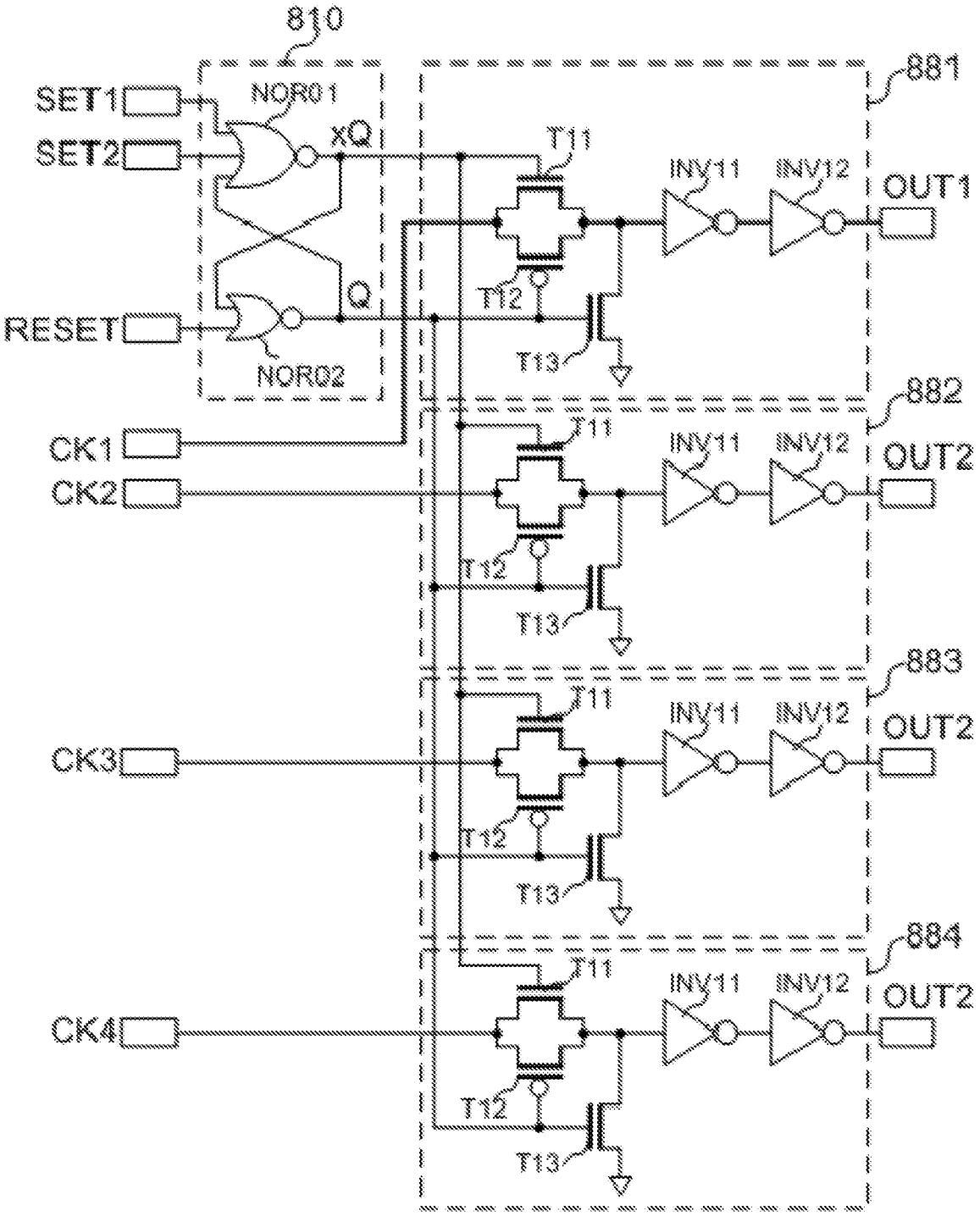
FIG. 13 is a schematic diagram showing a circuit structure of a gate scanning unit circuit in a first gate scanning circuit according to a second embodiment.

Referring to FIG. 13, the first gate scanning circuit 120 in this embodiment differs from the first gate scanning circuit 120 in the first embodiment in that each gate scanning unit circuit 121 of the first gate scanning circuit 120 includes four output units, namely a first output unit 881, a second output unit 882, a third output unit 883, and a fourth output unit 884. The third output unit 883 receives a third clock signal CK3 and has a third output terminal OUT3. The fourth output unit 884 receives a fourth clock signal CK4 and has a fourth output terminal OUT4. The first output unit 881, the second output unit 882, the third output unit 883, and the fourth output unit 884 are substantially the same. Each of the first output unit 881, the second output unit 882, the third output unit 883, and the fourth output unit 884 are connected to output ends of the first trigger signal QB and the second trigger signal Q of the trigger 810 and respectively connected to a corresponding gate line. Thus, in the second embodiment, each gate scanning unit circuit 121 is connected to four gate lines. The four gate lines are adjacently arranged, which is advantageous for reducing traces and further reducing the frame width.

Figure 14:
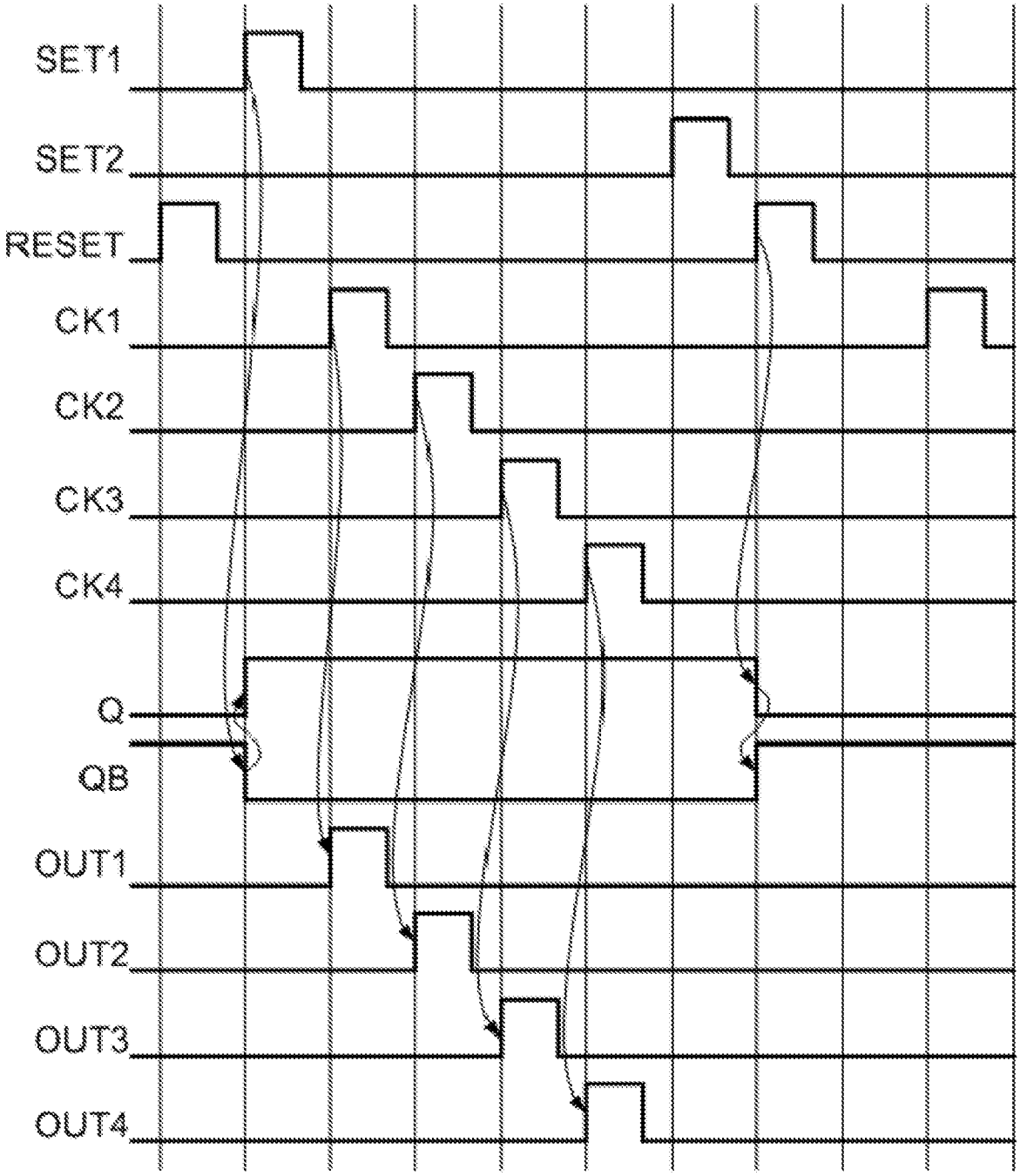
FIG. 14 is a timing diagram showing a forward scanning mode of the gate scanning unit circuit of FIG. 13.

In the second embodiment, the scanning mode of the gate scanning unit circuit 121 may be forward scanning or reverse scanning. Referring to FIG. 14, in the forward scanning mode, the set signal SET1, the first clock signal CK1, the second clock signal CK2, the third clock signal CK3, the fourth clock signal CK4, the set signal SET2, and the reset signal RESET become the high level in sequence. When the set signal SET1 becomes a high level, the first trigger signal QB of the flip-flop 810 is at the low level, and the second trigger signal Q is at the high level. In this scenario, when the first clock signal CK1, the second clock signal CK2, the third clock signal CK3, and the fourth clock signal CK4 become the high level in sequence, the gate scan signals output by the first output terminal OUT1, the second output terminal OUT2, the third output terminal OUT 3, and the fourth output terminal OUT4 respectively become the high level in sequence. Next, although the set signal SET2 becomes the high level, the second trigger signal Q and the first trigger signal QB of the flip-flop 810 do not change. Next, when the reset signal RESET becomes the high level, the second trigger signal Q of the flip-flop 810 becomes the low level, and the first trigger signal QB becomes the high level. As described above, in the forward scanning mode of the first output terminal OUT1, the second output terminal OUT2, the third output terminal OUT3, and the fourth output terminal OUT4, a clock of 7 or more phases is required.

A configuration and operation timing of the first gate scanning circuit 120 including the above-described gate scanning unit circuit 121 will be described below.

Figure 15:
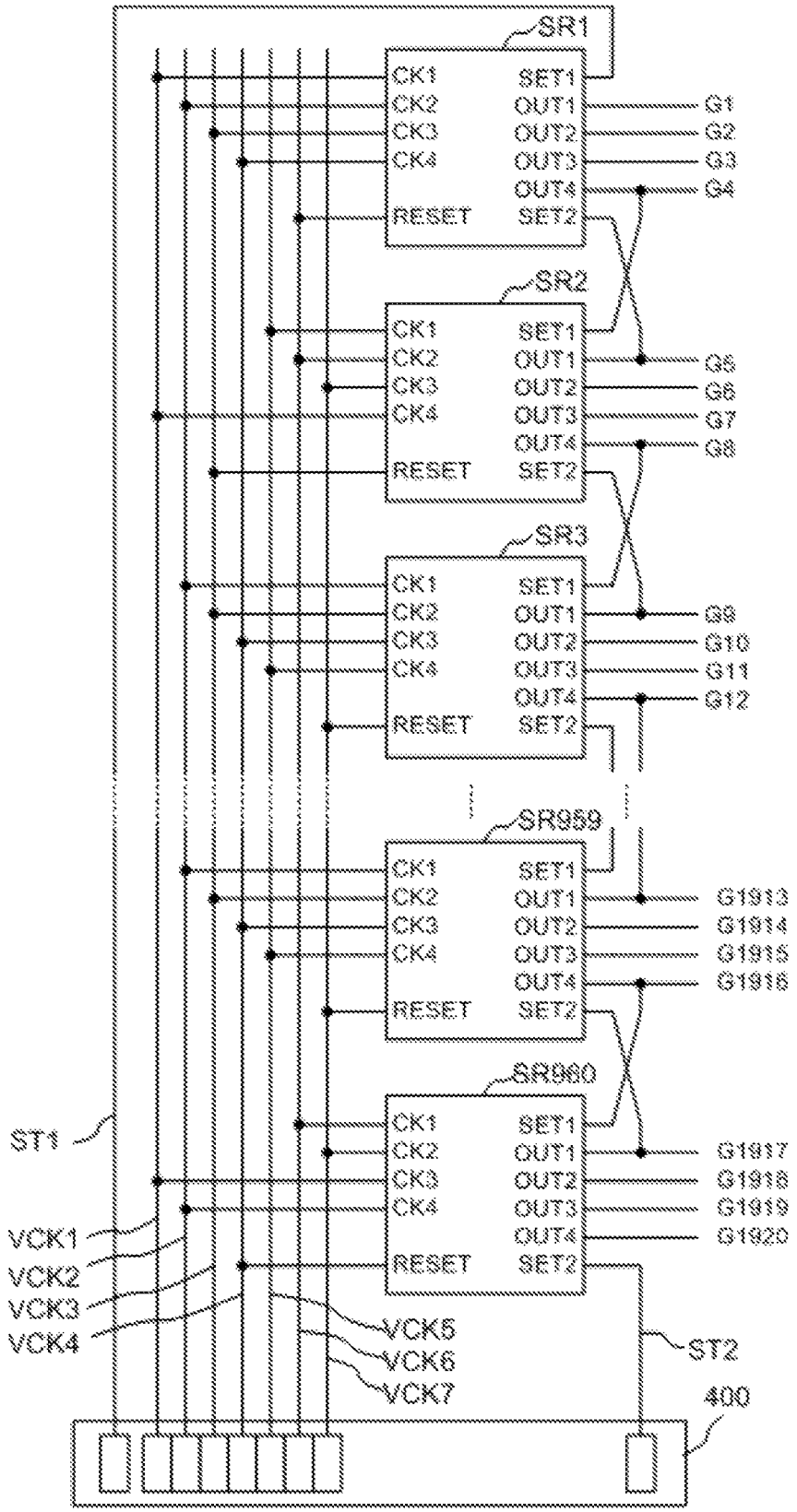
FIG. 15 is a schematic diagram showing a circuit structure of a first gate scanning circuit in the second embodiment.

Referring to FIG. 15, in the second embodiment, there are 1920 scan lines, which are respectively denoted as G1-G1920. The first gate scanning circuit 120 includes 960 gate scanning unit circuits 121, which are respectively denoted as SR1-SR960. Each of the gate scanning unit circuits SR1-SR960 is connected to four adjacent gate lines. For example, the gate scanning unit circuit SR1 is connected to the gate lines G1, G2, G3, and G4, and the gate scanning unit circuit SR2 is connected to the gate lines G5, G6, G7, and G8. The first gate scanning circuit 120 controls the clock signals (CK1-CK7) output from the driver 150 and the start signals ST1 and ST2, and outputs a gate scan signal to the gate lines G1-G1920.

Each of the gate scanning unit circuits 121 is connected step-by-step as exemplified by the gate scanning unit circuit SR2. The gate scanning unit circuit SR2 is connected to the driver 150, the adjacent upper-stage gate scanning unit circuit SR1, and the adjacent lower-stage gate scanning unit circuit SR3. An input terminal of the set signal SET1 of the gate scanning unit circuit SR2 is connected to the fourth output terminal OUT4 of the upper-stage gate scanning unit circuit SR1, and the input terminal of the set signal SR2 of the gate scanning unit circuit SET2 is connected to the first output terminal OUT1 of the lower-stage gate scanning unit circuit SR3. The driver 150 outputs seven clock signals VCK1-VCK7. The input terminal of the first clock signal CK1 of the gate scanning unit circuit SR2 is used for inputting the clock signal VCK5, the input terminal of the second clock signal CK2 is used for inputting the clock signal VCK6, the input terminal of the third clock signal CK3 is used for inputting the clock signal VCK7, and the input terminal of the fourth clock signal CK4 is used for inputting the clock signal VCK1.

Figure 16:
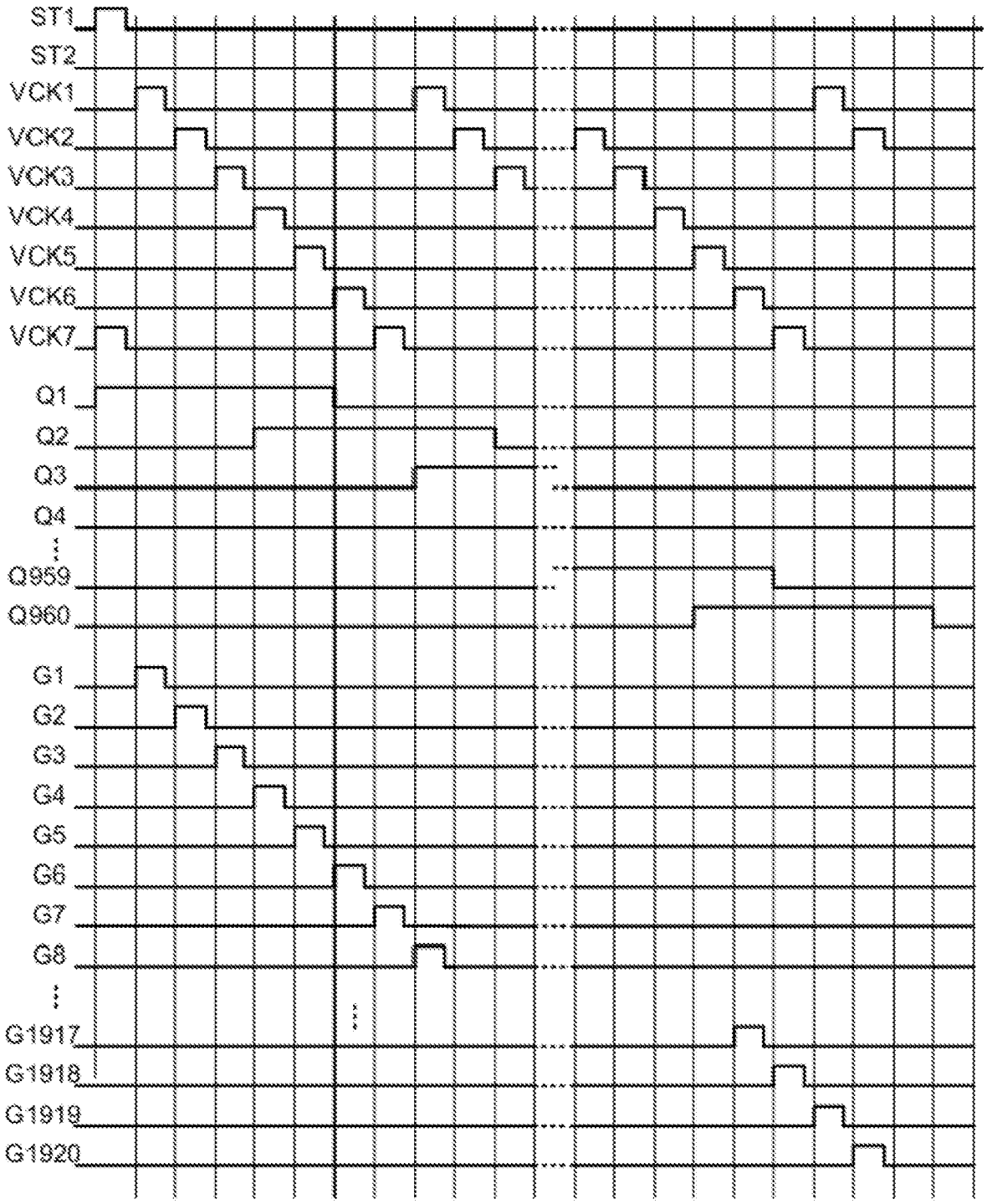
FIG. 16 is a timing diagram showing the forward scanning mode of the first gate scanning circuit of FIG. 15.

In one embodiment, each gate scanning unit circuit 121 scans in the forward scanning mode, and correspondingly, the first gate scanning circuit 120 scans in the forward scanning mode. Referring to FIG. 16, the clock signals VCK1, VCK2, VCK3, VCK4, VCK5, VCK6, and VCK7 become the high level in sequence. The start signal ST1 becomes the high level in the timing of the clock signal VCK7, and the start signal ST2 becomes the low level. The second trigger signal Q1 output by the gate scanning unit circuit SR1 becomes the high level in the timing of the start signal ST1, and becomes the low level in the timing of the clock signal VCK6. By outputting the second trigger signal Q1, the gate scan signals on the gate lines G1, G2, G3, and G4 sequentially become the high level in the timings of the clock signals VCK1, VCK2, VCK3, and VCK4, respectively. The second trigger signal Q2 output by the gate scanning unit circuit SR2 becomes the high level in the timing of the gate scan signal on the gate line G4, and becomes the low level in the timing of the clock signal VCK1. By outputting the second trigger signal Q2, the gate scan signals on the gate lines G5, G6, G7, and G8 sequentially become the high level in the timing of the clock signals VCK5, VCK6, VCK7, and VCK1, respectively. Similarly, the second trigger signal Q1 output by the gate scanning unit circuit SR3 becomes the high level in the timing of the gate scan signal on the gate line G8, and becomes the low level in the timing of the clock signal VCK7. By outputting the second trigger signal Q3, the gate lines G9, G10, G11, and G12 become the high level in the timing of the clock signals VCK2, VCK3, VCK4, and VCK5, and the timings of the output of subsequent signals are similar as described above.

As described above, the gate lines G1-G1920 output signals whose phases change in the forward scanning direction.

Figure 17:
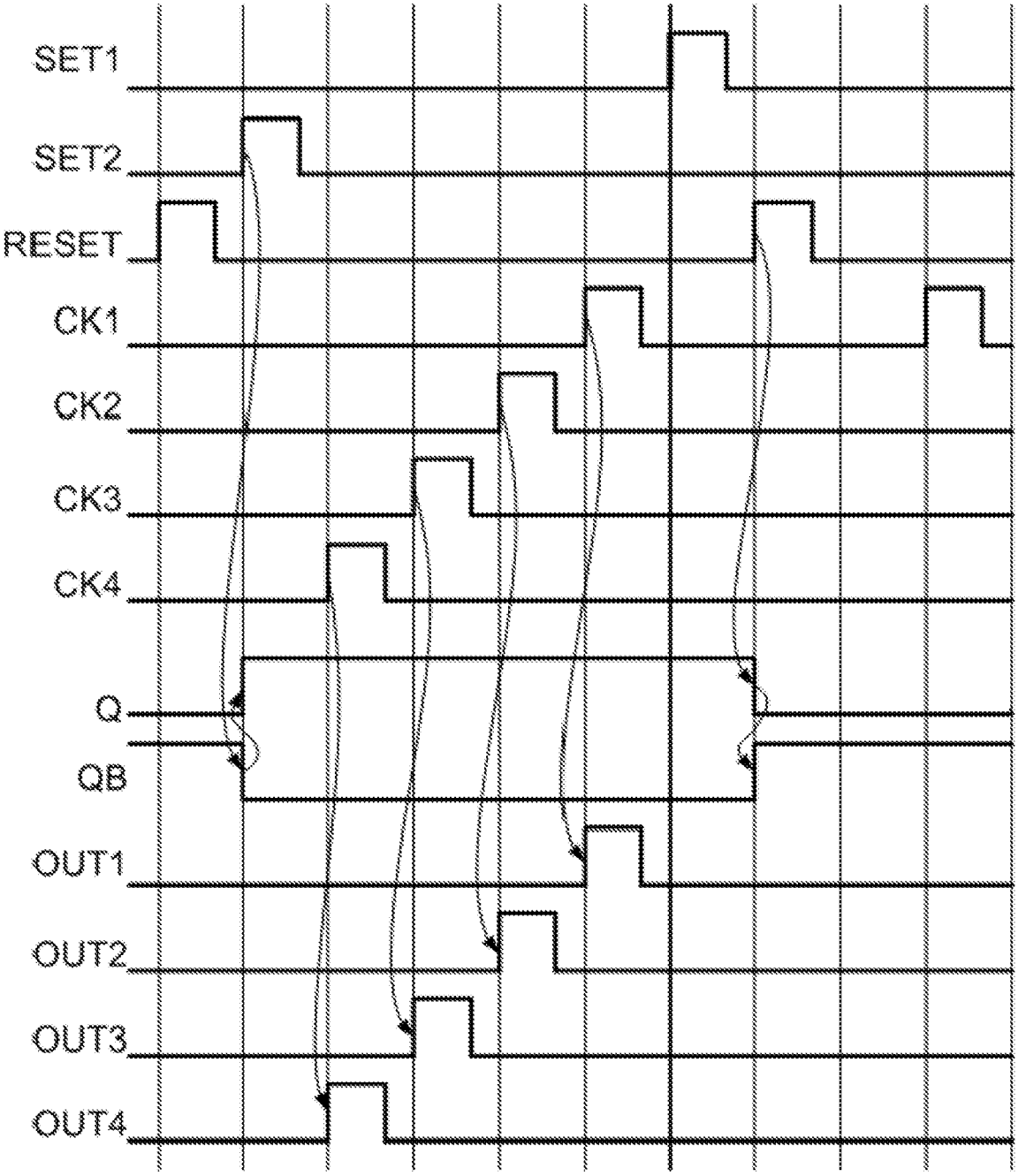
FIG. 17 is a timing diagram showing the reverse scanning mode of the gate scanning unit circuit of FIG. 13.

Referring to FIG. 13 and FIG. 17, in one embodiment, each of the gate scanning unit circuits 121 operates in the reverse scanning mode, and the set signal SET2, the fourth clock signal CK4, the third clock signal CK3, the second clock signal CK2, the first clock signal CK1, the set signal SET1, and the reset signal RESET become the high level in sequence. When the set signal SET2 becomes the high level, the first trigger signal QB of the flip-flop 810 becomes the high level, and the second trigger signal Q becomes the low level. In this scenario, the gate scan signals output by the fourth output terminal OUT4, the third output terminal OUT3, the second output terminal OUT2, and the first output terminal OUT1 become the high level in the timing of the fourth clock signal CK4, the third clock signal CK3, the second clock signal CK2, and the first clock signal CK1, respectively. Next, although the set signal SET1 becomes the high level, the second trigger signal Q and the first trigger signal QB of the flip-flop 810 do not change. Then, when the reset signal RESET becomes the high level, the second trigger signal Q of the flip-flop 810 becomes the low level, and the first trigger signal QB becomes the high level.

As described above, the fourth output terminal OUT4, the third output terminal OUT3, the second output terminal OUT2, and the first output terminal OUT1 output the gate scan signals in the reverse scanning order, and a clock of 7 or more phases is required.

Figure 18:
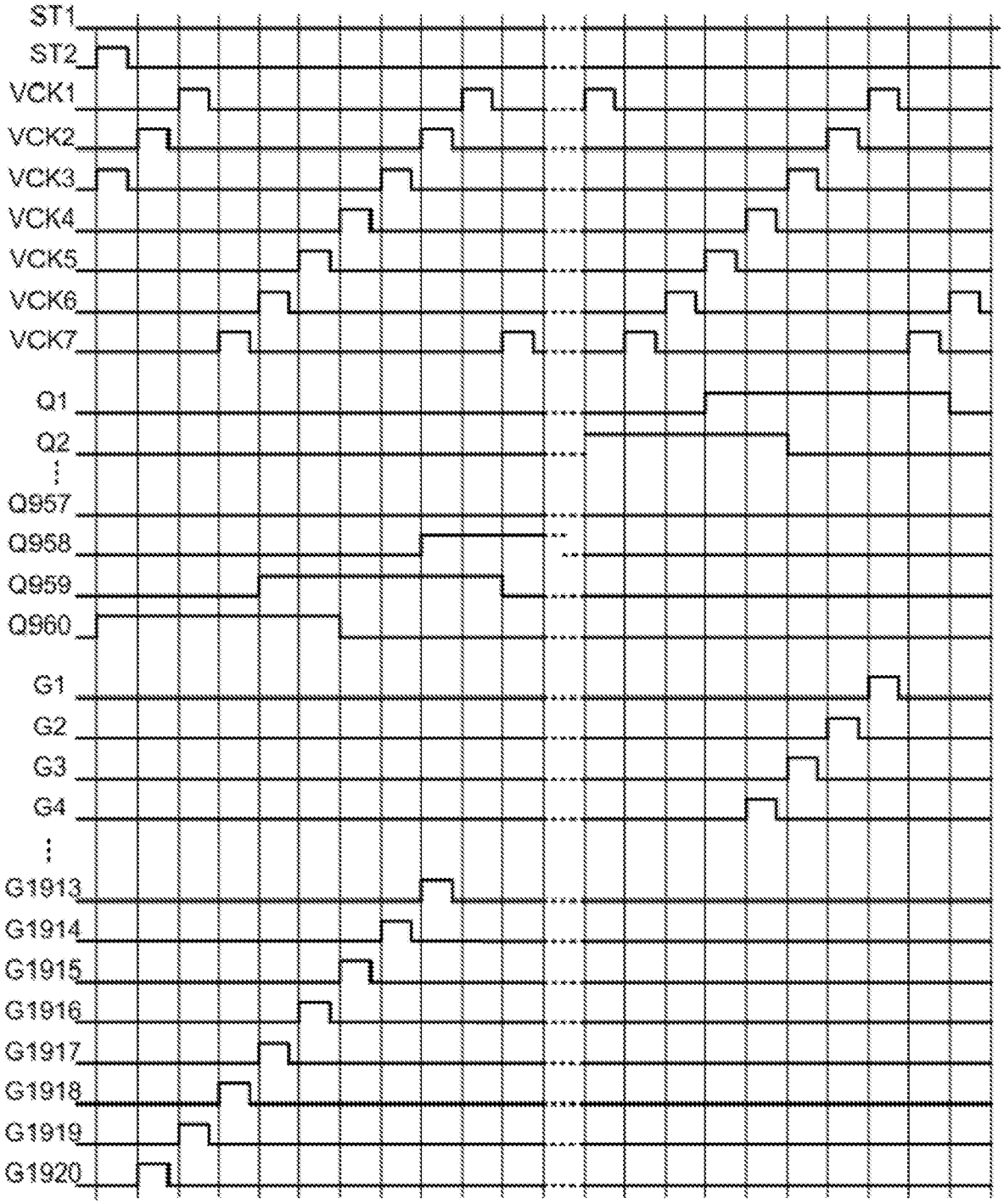
FIG. 18 is a timing diagram showing the reverse scanning mode of the first gate scanning circuit of FIG. 15.

Referring to FIG. 15 and FIG. 18, each of the gate scanning unit circuits SR1-SR960 scans in the reverse scanning mode, and the first gate scanning circuit 120 correspondingly scans in the reverse scanning mode. The clock signals VCK7, VCK6, VCK5, VCK4, VCK3, VCK2, and VCK1 become the high level in sequence. The start signal ST1 becomes the low level, and the start signal ST2 becomes the high level in the timing of the clock signal VCK3. The gate scanning unit circuit SR960 of the first gate scanning circuit 120 outputs the second trigger signal Q960 at the high level in the timing of the start signal ST1, and at the low level in the timing of the clock signal VCK4. By outputting the second trigger signal Q960, the gate scan signals on the gate lines G1920, G1919, G1918, and G1917 become the high level in the timing of the clock signals VCK2, VCK1, VCK7, and VCK6, respectively. Further, the second trigger signal Q959 becomes the high level in the timing of the gate scan signal on the gate line G1917, and becomes the low level in the timing of the clock signal VCK7. By outputting the second trigger signal Q959, the gate lines G1916, G1915, G1914, and G1913 become the high level in the timing of the clock signals VCK5, VCK4, VCK3, and VCK3, respectively.

As described above, the gate lines G1-G1920 output the gate scan signals in the reverse scanning direction.

The circuit structure and the operation timing of the first gate scanning circuit 120 are the same as the circuit structure and the operation timing of the second gate scanning circuit 130. The first gate scanning circuit 120 and the second gate scanning circuit 130 include the same number of gate scanning unit circuits 121, and the gate scanning unit circuits 121 in the first gate scanning circuit 120 are in one-to-one correspondence with the gate scanning unit circuits 121 in the second gate scanning circuit 130. Each gate scanning unit circuit 121 in the first gate scanning circuit 120 and the corresponding gate scanning unit circuit 121 in the second gate scanning circuit 130 are connected to the same four gate lines, that is, each gate line is scanned simultaneously by the corresponding two gate scanning unit circuits 121. Thus, even though the display panel 100 defines the area C where corresponding gate lines are cut into separate segments, each segment is connected to a corresponding gate scanning unit circuit to perform scanning. Thus, it is not necessary to set a trace connection between the two segments, which is advantageous for reducing a frame width of the display panel 100.

Moreover, in the gate scanning unit circuit, one flip-flop is connected to four output units, each output unit is connected to one gate line, and one gate scanning unit circuit is connected to four gate lines, thereby reducing the required number of flip-flops. Thus, compared to the first embodiment, each gate scanning unit circuit is connected to a larger number of gate lines, a number of the flip-flops is further reduced, and a manufacturing cost and a frame width of the display panel are further reduced.

Embodiment 3

Figure 19:
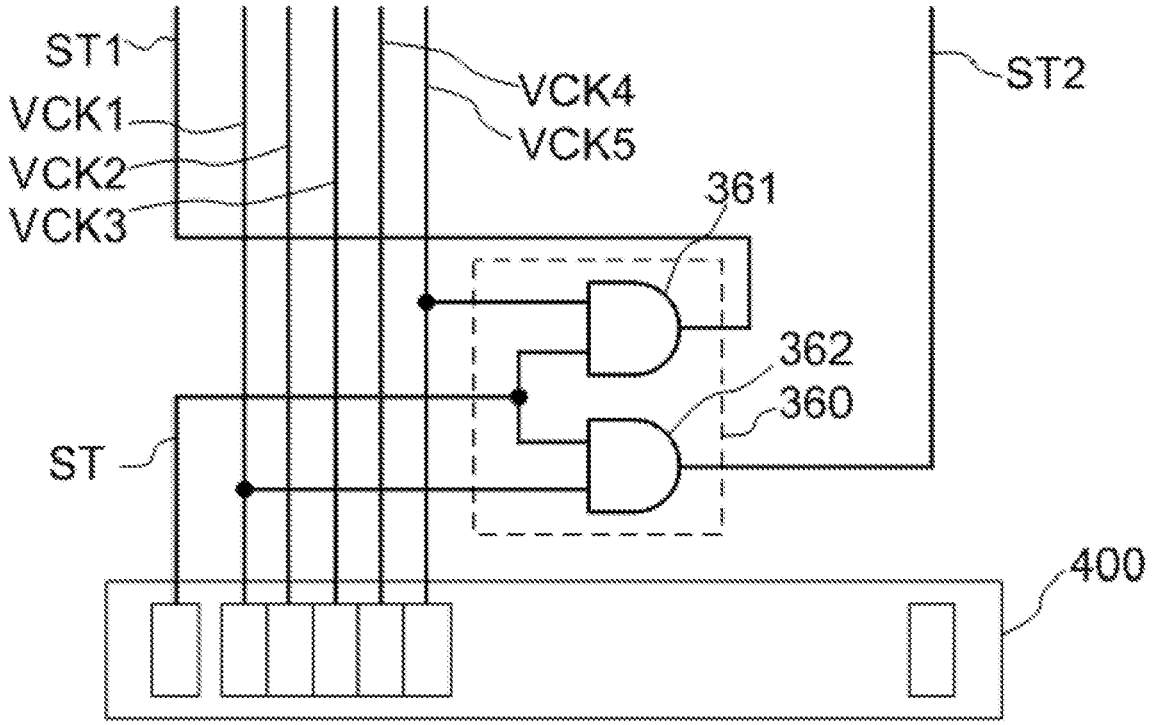
FIG. 19 is a schematic structural diagram of a first gate scanning circuit according to a third embodiment.

Referring to FIG. 19, in the third embodiment, the first gate scanning circuit 120 further includes a start signal control circuit 360. The start signal control circuit 360 includes a logic AND circuit 361 and a logic AND circuit 362. The start signal ST1 is a logic AND of the start signal ST of the driver 150 and the clock signal VCK5 from the driver 150. The start signal ST2 is a logic AND of the start signal ST from the driver 150 and the clock signal VCK1 from the driver 150.

Figure 20:
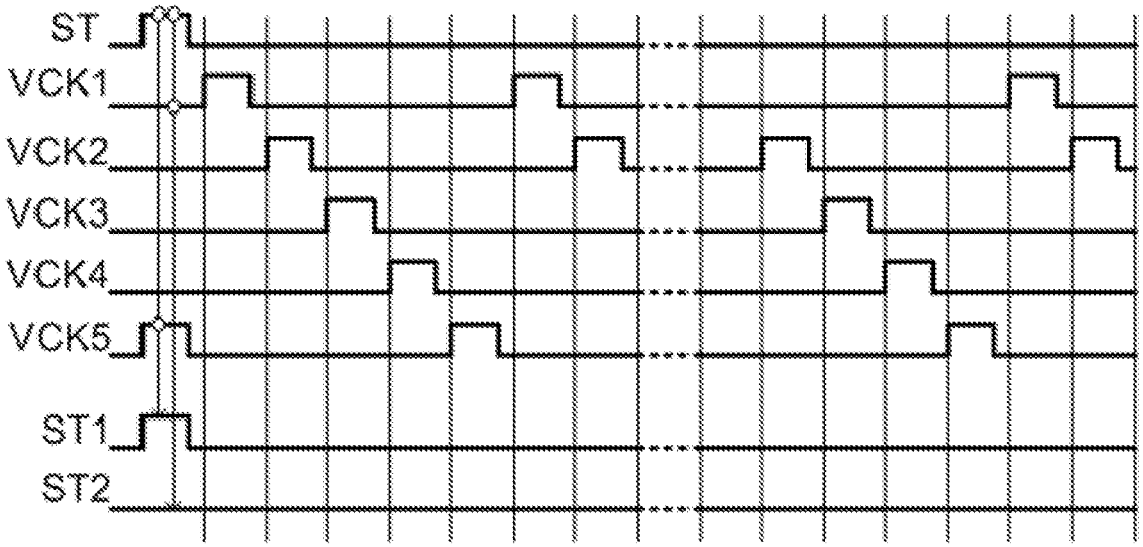
FIG. 20 is a timing diagram showing a forward scanning mode of the first gate scanning circuit of FIG. 19.

In this embodiment, the first gate scanning circuit 120 can also scan in the forward scanning mode and the reverse scanning mode. Referring to FIG. 20, in the forward scanning mode, since the start signal ST of the driver 150 becomes the high level in the timing of the clock signal VCK5, a timing of the start signals ST1 and ST2 are the same as shown in FIG. 7.

Figure 21:
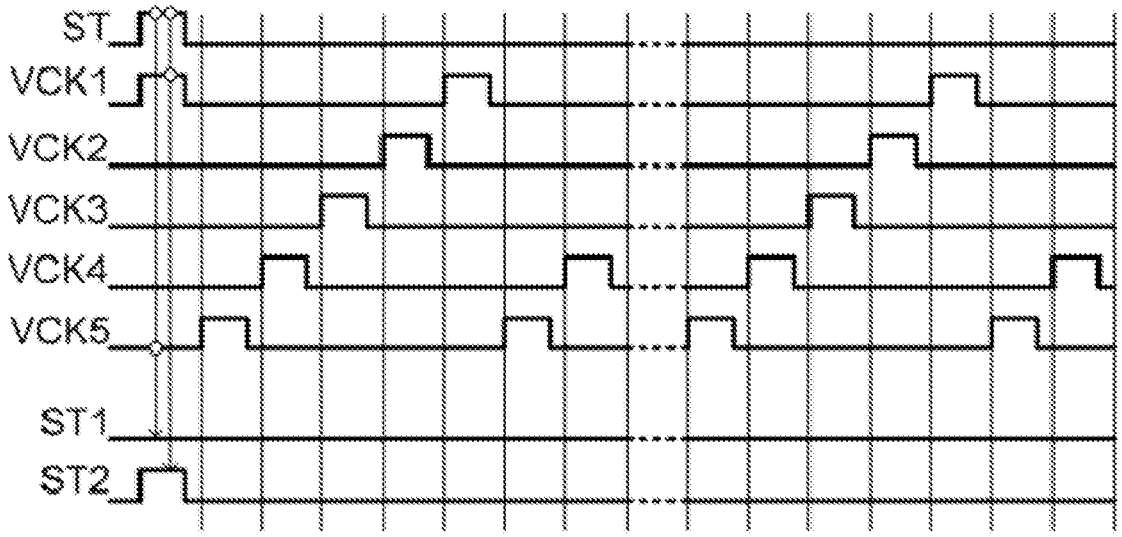
FIG. 21 is a timing diagram showing a reverse scanning mode of the first gate scanning circuit of FIG. 19.

Referring to FIG. 21, in the reverse scanning mode, since the start signal ST of the driver 150 becomes the high level in the timing of the clock signal VCK1, a timing of the start signals ST1 and ST2 are the same as shown in FIG. 9. The above-described circuit configuration can achieve the beneficial effects as described in the first embodiment and can reduce the number of traces from the driver 150. The structure and operation timing of the second gate scan circuit 130 is substantially similar to the structure and operation timing of the first gate scan circuit 120, and will not be described herein.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A gate scanning unit circuit applied in a display panel comprising a plurality of gate lines and a driver configured to output clock signals, the gate scanning unit circuit configured to scan the plurality of gate lines, the gate scanning unit circuit comprising:

a flip-flop configured to output a trigger signal; and at least two output units, each output unit connected to the flip-flop and the driver, each of the at least two output units is connected to one of the plurality of gate lines, the output unit is configured to output a gate scan signal to the corresponding connected gate line according to the trigger signal and the clock signals;

wherein the at least two output units comprise a first output unit;

the first output unit is connected to the flip-flop and a first gate line and is configured to output a first gate scan signal to the first gate line according to the trigger signal and a first clock signal output by the driver; and wherein the flip-flop is a set/reset flip-flop composed of two NOR gates; the flip-flop is configured for outputting a first trigger signal and a second trigger signal by receiving two set signals and a reset signal;

wherein the first output unit comprises a first transistor, a second transistor, a third transistor, a first inverter, and a second inverter;

a gate of the first transistor is connected to an output end of a first trigger signal of the flip-flop; a gate of the second transistor is connected to an output end of a second trigger signal of the flip-flop; a source of the first transistor and a source of the second transistor are connected to each other and connected to the driver to receive a first clock signal output by the driver; a drain of the first transistor and a drain of the second transistor are sequentially connected to the first inverter and the second inverter; the first output unit comprises an output terminal connected between the second inverter and the first gate line.

2. The gate scanning unit circuit of claim 1, wherein:

each of the at least two output units has a similar circuit structure.

3. The gate scanning unit circuit of claim 2, wherein:

each of the first inverter and the second inverter comprises a transistor; and a gate width of the transistor is set according to a load capacitance of one corresponding gate line connected to the second inverter.

4. The gate scanning unit circuit of claim 2, wherein:

the at least two output units further comprise a second output unit;

the second output unit is connected to the flip-flop and a second gate line and is configured to output a second gate scan signal to the second gate line according to the trigger signal and a second clock signal output by the driver.

5. The gate scanning unit circuit of claim 4, wherein: the second output unit comprises a first transistor, a second transistor, a third transistor, a first inverter, and a second inverter;

in the second output unit, a gate of the first transistor is connected to an output end of a first trigger signal of the flip-flop; a gate of the second transistor is connected to an output end of a second trigger signal of the flip-flop; a source of the first transistor and a source of the second transistor are connected to each other and connected to the driver to receive a second clock signal output by the driver; a drain of the first transistor and a drain of the second transistor are sequentially connected to the first inverter and the second inverter; the second output unit comprises an output terminal connected between the second inverter and the second gate line.

6. The gate scanning unit circuit of claim 1, wherein:

the gate lines connected to the output units are adjacently arranged.

7. A gate scanning circuit applied in a display panel comprising a plurality of gate lines and a driver configured to output clock signals, the gate scanning circuit comprising:

a first gate scanning circuit; and a second gate scanning circuit; wherein:

each of the first gate scanning circuit and the second gate scanning circuit comprises a plurality of gate scanning unit circuits;

each gate scanning unit circuit is configured to scan the plurality of gate lines;

the gate scanning unit circuit comprises a flip-flop and at least two output units;

the flip-flop is configured to output a trigger signal;

each output unit is connected to the flip-flop and the driver;

each of the at least two output units is connected to one of the plurality of gate lines;

the output unit is configured to output a gate scan signal to the corresponding connected gate line according to the trigger signal and the clock signals;

wherein the at least two output units comprise a first output unit;

the first output unit is connected to the flip-flop and a first gate line and is configured to output a first gate scan signal to the first gate line according to the trigger signal and a first clock signal output by the driver; and wherein the flip-flop is a set/reset flip-flop composed of two NOR gates; the flip-flop is configured for outputting a first trigger signal and a second trigger signal by receiving two set signals and a reset signal;

wherein the first output unit comprises a first transistor, a second transistor, a third transistor, a first inverter, and a second inverter;

a gate of the first transistor is connected to an output end of a first trigger signal of the flip-flop; a gate of the second transistor is connected to an output end of a second trigger signal of the flip-flop; a source of the first transistor and a source of the second transistor are connected to each other and connected to the driver to receive a first clock signal output by the driver; a drain of the first transistor and a drain of the second transistor are sequentially connected to the first inverter and the second inverter; the first output unit comprises an output terminal connected between the second inverter and the first gate line a number of the gate scanning unit circuits in the first gate scanning circuit and the second gate scanning circuit is the same, and the gate scanning unit circuits of the first gate scanning circuit correspond to the gate scanning unit circuits of the second gate scanning circuit one-to-one; and the gate scanning unit circuits of the first gate scanning circuit and the corresponding gate scanning unit circuits of the second gate scanning circuit are connected to the same gate line.

8. The gate scanning circuit of claim 7, wherein:

each of the at least two output units has a similar circuit structure.

9. The gate scanning circuit of claim 8, wherein:

each of the first inverter and the second inverter comprises a transistor; and a gate width of the transistor is set according to a load capacitance of one corresponding gate line connected to the second inverter.

10. The gate scanning circuit of claim 8, wherein:

the at least two output units further comprise a second output unit;

the second output unit is connected to the flip-flop and a second gate line and is configured to output a second gate scan signal to the second gate line according to the trigger signal and a second clock signal output by the driver.

11. The gate scanning circuit of claim 7, wherein:

the gate lines connected to the output units are adjacently arranged.

12. A display panel comprising:

a gate scanning circuit;

a plurality of gate lines connected to the gate scanning circuit; and a driver configured to output clock signals; wherein:

the gate scanning circuit comprises a first gate scanning circuit and a second gate scanning circuit;

each of the first gate scanning circuit and the second gate scanning circuit comprises a plurality of gate scanning unit circuits;

each gate scanning unit circuit is configured to scan the plurality of gate lines;

the gate scanning unit circuit comprises a flip-flop and at least two output units;

the flip-flop is configured to output a trigger signal;

each output unit is connected to the flip-flop and the driver;

each of the at least two output units is connected to one of the plurality of gate lines;

the output unit is configured to output a gate scan signal to the corresponding connected gate line according to the trigger signal and the clock signals;

wherein the at least two output units comprise a first output unit;

the first output unit is connected to the flip-flop and a first gate line and is configured to output a first gate scan signal to the first gate line according to the trigger signal and a first clock signal output by the driver; and wherein the flip-flop is a set/reset flip-flop composed of two NOR gates; the flip-flop is configured for outputting a first trigger signal and a second trigger signal by receiving two set signals and a reset signal;

wherein the first output unit comprises a first transistor, a second transistor, a third transistor, a first inverter, and a second inverter;

a gate of the first transistor is connected to an output end of a first trigger signal of the flip-flop; a gate of the second transistor is connected to an output end of a second trigger signal of the flip-flop; a source of the first transistor and a source of the second transistor are connected to each other and connected to the driver to receive a first clock signal output by the driver; a drain of the first transistor and a drain of the second transistor are sequentially connected to the first inverter and the second inverter; the first output unit comprises an output terminal connected between the second inverter and the first gate line;

a number of the gate scanning unit circuits in the first gate scanning circuit and the second gate scanning circuit is the same, and the gate scanning unit circuits of the first gate scanning circuit correspond to the gate scanning unit circuits of the second gate scanning circuit one-to-one; and the gate scanning unit circuits of the first gate scanning circuit and the corresponding gate scanning unit circuits of the second gate scanning circuit are connected to the same gate line.

13. The display panel of claim 12, wherein:

each of the at least two output units has a similar circuit structure.

14. The display panel of claim 13, wherein:

each of the first inverter and the second inverter comprises a transistor; and a gate width of the transistor is set according to a load capacitance of one corresponding gate line connected to the second inverter.

15. The display panel of claim 13, wherein:

the at least two output units further comprise a second output unit;

the second output unit is connected to the flip-flop and a second gate line and is configured to output a second gate scan signal to the second gate line according to the trigger signal and a second clock signal output by the driver.

16. The display panel of claim 12, wherein:

the gate lines connected to the output units are adjacently arranged.

* * * * *